US009013528B2

(12) United States Patent
Takahashi et al.

(10) Patent No.: US 9,013,528 B2
(45) Date of Patent: Apr. 21, 2015

(54) HANDHELD PRINTER

(71) Applicant: Brother Kogyo Kabushiki Kaisha, Nagoya-shi, Aichi (JP)

(72) Inventors: Toshihiro Takahashi, Nagoya (JP); Keiji Seo, Nagoya (JP); Hidenori Jo, Nagoya (JP); Toshiyuki Furuyama, Nagoya (JP); Shuhei Nohara, Nagoya (JP); Masato Nagura, Nagoya (JP); Takehiko Inaba, Nagoya (JP); Toshiyuki Ohmori, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/689,864

(22) Filed: Nov. 30, 2012

(65) Prior Publication Data

US 2014/0043422 A1 Feb. 13, 2014

Related U.S. Application Data

(63) Continuation-in-part of application No. PCT/JP2011/054544, filed on Feb. 25, 2011.

(30) Foreign Application Priority Data

| | | |
|---|---|---|
| Jun. 4, 2010 | (JP) | 2010-128879 |
| Jun. 4, 2010 | (JP) | 2010-128880 |
| Jun. 4, 2010 | (JP) | 2010-128881 |
| Jun. 4, 2010 | (JP) | 2010-128882 |
| Jun. 4, 2010 | (JP) | 2010-128883 |
| Jun. 4, 2010 | (JP) | 2010-128884 |
| Sep. 13, 2010 | (JP) | 2010-204203 |

(51) Int. Cl.
*B41J 2/32* (2006.01)
*B41J 3/36* (2006.01)

(Continued)

(52) U.S. Cl.
CPC *B41J 3/36* (2013.01); *B41J 29/023* (2013.01); *B41J 29/02* (2013.01); *B41J 29/04* (2013.01)

(58) Field of Classification Search
USPC ..... 347/171.222, 171, 222; 358/1.15, 400, 358/473, 496, 498
See application file for complete search history.

(56) References Cited

U.S. PATENT DOCUMENTS 5,294,941 A 3/1994 Yamada et al.
5,420,701 A * 5/1995 Terashima et al. ..... 358/498

(Continued)

FOREIGN PATENT DOCUMENTS

EP 0 855 281 7/1998
JP 63-178053 7/1988

(Continued)

OTHER PUBLICATIONS

Chinese Office Action issued in Application No. 201180027625.1 on Apr. 25, 2014.

(Continued)

*Primary Examiner* — Kristal Feggins
(74) *Attorney, Agent, or Firm* — McCarter & English, LLP

(57) ABSTRACT

This disclosure discloses a handheld printer comprising a battery power supply, a platen roller configured to feed the print-receiving paper, a thermal line head configured to perform desired printing on the print-receiving paper fed by the platen roller, a device main body comprising a battery storage chamber configured to store the battery power supply, and a battery chamber cover detachably configured to be mounted on the battery storage chamber.

9 Claims, 20 Drawing Sheets

(51) Int. Cl.
*B41J 29/02* (2006.01)
*B41J 29/04* (2006.01)

(56) References Cited

U.S. PATENT DOCUMENTS

| | | | | |
|---|---|---|---|---|
| 5,570,962 | A | 11/1996 | Suzuki et al. | |
| 5,706,101 | A * | 1/1998 | Yokoyama et al. | 358/400 |
| 5,835,107 | A | 11/1998 | Suzuki et al. | |
| 5,876,129 | A | 3/1999 | Suzuki | |
| 6,634,819 | B2 | 10/2003 | Uchida | |
| 7,150,637 | B2 | 12/2006 | Ohmori | |
| 7,443,408 | B2 | 10/2008 | Tozaki | |
| 7,712,816 | B2 | 5/2010 | Ujimoto et al. | |
| 2005/0197002 | A1 | 9/2005 | Ohmori et al. | |
| 2007/0243886 | A1 | 10/2007 | Taniguchi | |
| 2009/0029746 | A1 | 1/2009 | Yanagihashi et al. | |
| 2009/0248382 | A1 | 10/2009 | Ishikawa et al. | |
| 2013/0083356 | A1 * | 4/2013 | Yu | 358/1.15 |

FOREIGN PATENT DOCUMENTS

| | | |
|---|---|---|
| JP | 02-130360 | 10/1990 |
| JP | 05-048693 | 2/1993 |
| JP | H0532025 | 2/1993 |
| JP | H05-50702 | 3/1993 |
| JP | 06-143742 | 5/1994 |
| JP | 07-112564 | 5/1995 |
| JP | 07-309041 | 11/1995 |
| JP | 08-052923 | 2/1996 |
| JP | 08-282772 | 10/1996 |
| JP | 09-180779 | 7/1997 |
| JP | H10826 | 1/1998 |
| JP | 1041871 | 2/1998 |
| JP | 10-135661 | 5/1998 |
| JP | 10149232 | 6/1998 |
| JP | 10-222269 | 8/1998 |
| JP | 10-272808 | 10/1998 |
| JP | 11-151826 | 6/1999 |
| JP | 11-230263 | 8/1999 |
| JP | 2001184143 | 7/2001 |
| JP | 2001-339528 | 12/2001 |
| JP | 2002-083490 | 3/2002 |
| JP | 2002-103736 | 4/2002 |
| JP | 2002-160419 | 6/2002 |
| JP | 2002-178594 | 6/2002 |
| JP | 2002-237915 | 8/2002 |
| JP | 2003025682 | 1/2003 |
| JP | 3094637 | 4/2003 |
| JP | 2003-195697 | 7/2003 |
| JP | 200573224 | 3/2005 |
| JP | 2005-251547 | 9/2005 |
| JP | 200612497 | 1/2006 |
| JP | 2006101417 | 4/2006 |
| JP | 2006-311452 | 11/2006 |
| JP | 2007-216440 | 8/2007 |
| JP | 2007-253448 | 10/2007 |
| JP | 2007-292187 | 11/2007 |
| JP | 2007288433 | 11/2007 |
| JP | 2007334094 | 12/2007 |
| JP | 2008-049922 | 3/2008 |
| JP | 2009-026211 | 2/2009 |
| JP | 2009-226757 | 10/2009 |
| JP | 2009-245307 | 10/2009 |
| JP | 2009-295512 | 12/2009 |

OTHER PUBLICATIONS

International Search Report of PCT/JP2011/054544.
International Preliminary Report on Patentability issued in International Application No. PCT/JP2011/054544 on Jan. 17, 2013.
Japanese Office Action issued in Application No. 2010-128881 on Dec. 26, 2013.
Japanese Office Action issued in Application No. 2010-128882 on Jan. 7, 2014.
Japanese Office Action issued in Application No. 2010-128883 on Jan. 7, 2014.
Japanese Office Action issued in Application No. 2010-128884 on Jan. 7, 2014.
Japanese Office Action issued in Application No. 2010-128879 on Feb. 5, 2014.
Japanese Office Action issued in Application No. 2010-128884 on Oct. 2, 2014.
Japanese Office Action issued in Application No. 2010-128883 on Aug. 5, 2014.
Japanese Office Action issued in Application No. 2010-128880 on Jul. 22, 2014.
Japanese Office Action issued in Application No. 2010-128882 on Jul. 22, 2014.

* cited by examiner

HANDHELD PRINTER

CROSS-REFERENCE TO RELATED APPLICATION

This is a CIP application PCT/JP2011/54544, filed Feb. 28, 2011, which was not published under PCT article 21(2) in English.

BACKGROUND

1. Field

The present disclosure relates to a handheld printer comprising a power key for turning the power on and off.

2. Description of the Related Art

One example of an electronic device comprising a plurality of operation keys is a handheld printer, for example. According to such a handheld printer, an arbitrary operation key is surrounded by other operation keys adjacently disposed.

Prior arts that prevent mistaken operation of an adjacent operation key when an arbitrary operation key is operated on an electronic device comprising such operation keys are known. According to this prior art, each operation key is designed with a convex surface shape, ensuring that an operator's finger does not contact any other adjacent operation key when the operator presses an arbitrary operation key with a finger, thereby preventing mistaken operation of the adjacent operation keys.

According to a handheld electronic device capable of handheld use, such as a handheld printer, etc., the electronic device generally comprises a power key for turning the power on and off and at least one function key for executing a predetermined function of the handheld electronic device. With such a handheld printer, the size of each key itself tends to be miniaturized to improve the miniaturization of the entire device, and each key tends to be centrally disposed in one location to improve space efficiency. As a result, when the power key and function key are adjacently disposed in particular, the possibility exists that the power of the device will be turned off due to mistaken operation of the power key each time the function key is operated, impeding normal operation.

When the prior art is utilized on such a handheld printer, the power key and function key are formed into a convex surface shape. However, in this case, the convex-shaped keys protrude from the device, causing inconveniences with the handheld printer, which demands miniaturization and portability. In particular, in a case where the power key is made convex in shape, concern arises regarding the mistaken operation of the power key by a contacting object, etc., when the device is carried. Thus, it cannot be said that the prior art is a favorable prior art for preventing mistaken operation for a handheld printer wherein the power key and function key are adjacently disposed.

SUMMARY

It is therefore an object of the present disclosure to provide a handheld printer capable of preventing mistaken operation of a power key and function key adjacently disposed.

In order to achieve the above-described object, according to the first aspect, there is provided a handheld printer comprising: a battery power supply; a platen roller configured to feed the print-receiving paper; a thermal line head configured to perform desired printing on the print-receiving paper fed by the platen roller; a device main body comprising a battery storage chamber configured to store the battery power supply; and a battery chamber cover detachably configured to be mounted on the battery storage chamber.

According to the handheld printer of the first aspect, the handheld printer comprises a device main body and a battery chamber cover detachable to the battery storage chamber of the device main body. With this arrangement, the battery power supply can be replaceably stored in the battery chamber, making it possible to cover and block the battery storage chamber by engaging the battery chamber cover.

In order to achieve the above-described object, according to the second aspect, there is provided a handheld printer comprising: a battery power supply; a platen roller configured to feed the print-receiving paper; a thermal line head configured to perform desired printing on the print-receiving paper fed by the platen roller; a power key for turning the power supply on and off; at least one function key for causing the handheld printer to execute a predetermined function, disposed adjacently to the power key; a first reaction force applying member configured to apply a reaction force in response to a pressing force of the power key; and a second reaction force applying member configured to apply a reaction force in response to a pressing force of the function key, the reaction force by the first reaction force applying member being larger than the reaction force by the second reaction force applying member.

The handheld printer according to the second aspect comprises a power key for turning the power on and off, and a function key for executing a predetermined function. First reaction force applying member applies to the power key a reaction force in response to the pressing force of the power key, and second reaction force applying member applies to the function key a reaction force in response to the pressing force of the function key. With this arrangement, a click feel is achieved when the operator presses each key, achieving a favorable feeling of operation.

With such a handheld printer, the size of each key itself tends to be miniaturized to improve the miniaturization of the entire device, and each key tends to be centrally disposed in one location to improve space efficiency. As a result, when the operator attempts to press a specific key, the possibility exists that the operator may mistakenly press an adjacent key as well. In particular, when the power key and function key are adjacently disposed, the possibility exists that the power of the device will be turned off due to mistaken operation of the power key each time the function key is operated, impeding normal operation.

Here, in the second aspect, the first reaction force applying member is configured to apply a reaction force larger than that of the second reaction force applying member. As a result, to operate the power key, a pressing force that is larger than that when operating the function key is required. With this arrangement, even if the operator mistakenly touches the adjacent power key when pressing the function key, the power key is difficult to press, making it possible to suppress mistaken operation of the power key. As a result, the operator can normally execute the operation without mistakenly turning off the power of the device. On the other hand, when the operator presses the power key, a relatively large force is required, causing the need to press an accurate position to arise and, as a result, a decrease in the possibility of touching the adjacent function key. Thus, it is possible to prevent mistaken operation of the adjacently disposed power key and function key.

Further, since the configuration is thus one wherein the size of the reaction force applied to each key is adjusted, it is possible to prevent mistaken operation even with flat-shaped keys in comparison to a case where mistaken operation of adjacent keys is prevented by designing each key with a convex surface shape. Accordingly, this configuration is advantageous in the case of a handheld printer which demands miniaturization and portability. Further, in a case where each key is made convex in shape as described above, while the contact surface area of the key surface and operator finger is significantly decreased, resulting in the concern of a decrease in operability as well as a significant impact on the outer appearance of the device, a resolution can be made according to the second aspect without changing the surface shape of each key, making it possible to eliminate such concern and impact.

In order to achieve the above-described object, according to the third aspect, there is provided a handheld printer comprising: a platen roller configured to feed the print-receiving paper; a thermal line head configured to perform desired printing on the print-receiving paper fed by the platen roller; a pair of side chassis members configured to support the platen roller in a rotatable manner and support the thermal line head so that said thermal line head can press against the platen roller; a housing comprising a top cover constituting a device contour upper part and an undercover constituting a device contour lower part; and a chassis assembly comprising the pair of side chassis members, wherein: the housing encloses the chassis assembly; the chassis assembly further comprises an installation part where a screw hole is formed; the top cover comprises a first boss part provided protruding toward the device inside; the undercover comprises a second boss part provided protruding toward the device inside to a position corresponding to the first boss part of the top cover; the chassis assembly, the top cover, and the undercover are assembled to each other by inserting a screw inserted from one of the first boss part and the second boss part through the screw hole of the installation part and connecting the screw to the other the boss part; and a buffering member is provided between at least one of the first boss part and the second boss part and the installation part.

The handheld printer according to the third aspect comprises a platen roller, a thermal line head, and a pair of side chassis members that supports these, and a housing comprising a top cover and an undercover.

With this arrangement, it is a possible to provide a buffering member between the top cover and undercover and side chassis members for impact absorption, fix the spacing of the side chassis members at the middle position thereof to suppress deformation of the side chassis members caused by the inertia of a heavy object, provide a guide member separate from the housing to the side chassis members to improve the relative positional accuracy of the guide member to the platen roller and thermal line head, and provide a coil spring to the main chassis member provided to the undercover to suppress the variance in the pressing load when the thermal line head presses against the platen roller as a result of that energizing force, for example.

The handheld printer according to the third aspect comprises a chassis assembly comprising a platen roller, a thermal line head, and a pair of side chassis members that supports these, and a housing comprising a top cover and an undercover. Then, the chassis assembly, top cover, and undercover are assembled to each other by inserting a screw inserted from either the first boss part provided to the top cover or the second boss part provided to the undercover through the screw hole of the installation part of the chassis assembly and connecting the screw to the other boss part.

At this time, according to the third aspect, a buffering part is provided between at least one of the first boss part of the top cover and the second boss part of the undercover, and the installation part of the chassis assembly. With this arrangement, in a case where the handheld printer is subjected to high impact when dropped, etc., it is possible to absorb the impact transmitted from the top cover and the undercover to the chassis assembly by the buffering member. As a result, the occurrence of a defect in the platen roller and thermal line head as a result of impact can be suppressed, making it possible to achieve a handheld printer with high impact resistance when dropped, etc.

DETAILED DESCRIPTION OF THE PREFERRED EMBODIMENTS

The following describes one embodiment of the present disclosure with reference to accompanying drawings.

Figure 1:
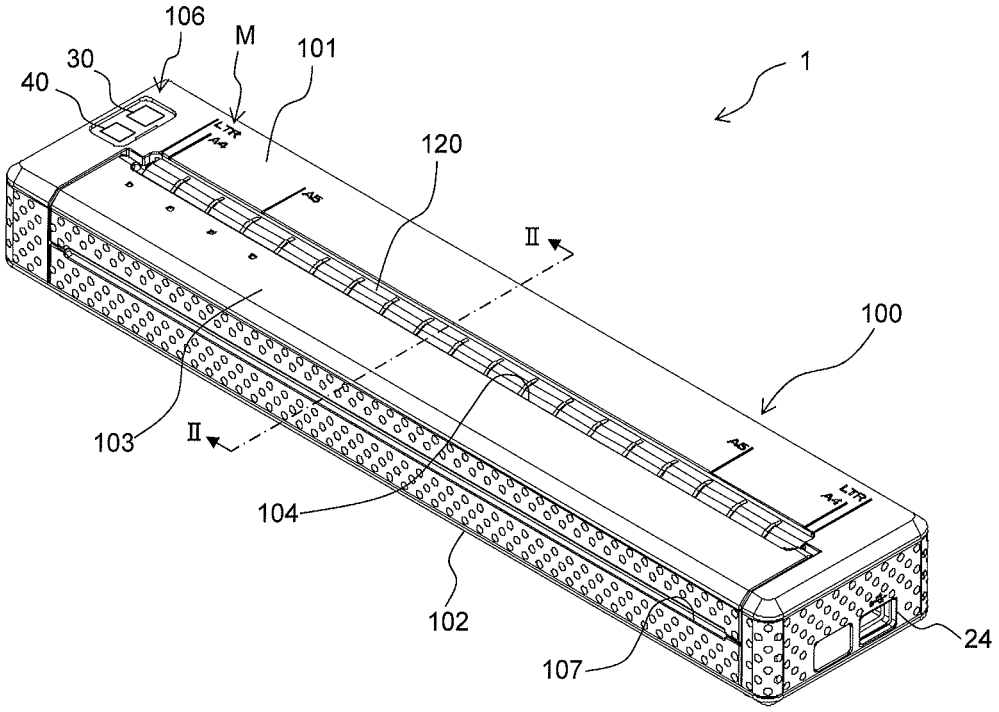
FIG. 1 is a perspective view showing the outer appearance configuration of a handheld printer which is an embodiment of the present disclosure.

The outer configuration of a handheld printer 1, which is one embodiment of the present disclosure, will now be described with reference to FIG. 1. In the following, the downward left direction, upward right direction, upward left direction, and downward right direction in FIG. 1 are respectively described as front, rear, left, and right.

The handheld printer 1 prints print data received from an external device 2 (refer to FIG. 3 described later), such as a PC terminal or handheld telephone for example, on a print-receiving paper S via wired or wireless communication. This handheld printer 1 can be driven by a rechargeable battery 10 (refer to FIG. 2, etc., described later) as its power supply, and can be carried to various locations for use.

The handheld printer 1 comprises a substantially right-angled parallelepiped shaped housing 100 which constitutes the device contour and is made of a resin material. This housing 100 comprises a top cover 101 constituting an upper part of the device contour, an undercover 102 constituting a lower part of the device contour, and a cover member 103 openably and closeably provided to the upper front side of the top cover 101. At the time of printing, the print-receiving paper S is inserted into an insertion port 104 formed between the top cover 101 and the cover member 103. The inserted print-receiving paper S is guided to a pressing part P (refer to FIG. 2) of a platen roller 111 and a thermal line head 112 described later by a guide member 120 provided below the insertion port 104, and discharged after printing is completed from a discharging exit 107 formed between the cover member 103 and the undercover 102.

The internal structure of the handheld printer 1 will now be described with reference to FIG. 2.

The platen roller 111 and the thermal line head 112 are provided within the housing 100 of the handheld printer 1. The platen roller 111 is rotatably supported by a pair of side chassis members 130L and 130R (refer to FIG. 9, etc., described later) provided in the interior of the housing 101, and feeds the print-receiving paper S when rotationally driven by a drive motor 11 (refer to FIG. 3, etc., described later). The thermal line head 112 is provided on a heat sink 114 comprising a shaft member 113 on a rear end, and this heat sink 114 is supported so that it can rotate around the shaft member 113 by the above described side chassis members 130L and 130R. Further, a plurality of coil springs 115 configured to rotate and energize the heat sink 114 that supports the above described thermal line head 112 to the platen roller 111 side is provided to the main chassis member 150 provided to the inner surface of the undercover 102. With this arrangement, the thermal line head 112 is capable of pressing against the above described platen roller 111, and thus contacts the platen roller 111 using a predetermined contact pressure during printing, and performs desired printing on the print-receiving paper S inserted therebetween.

When regular printing is performed, the print-receiving paper S is inserted into the insertion port 104 with the cover member 103 closed, causing the print-receiving paper S to be fed by the platen roller 111 while guided by the above described guide member 120, and desired printing is performed by the thermal line head 112. In a case where a paper jam or the like occurs, the platen roller 111 is released from the thermal line head 112 by opening the cover member 103, making it possible to easily pull out the paper.

A battery storage chamber 105 configured to store the substantially bar-shaped rechargeable battery 10 is provided to the rear side of the housing 100, and a battery chamber cover 170 is detachably provided to this battery storage chamber 105. With the battery chamber cover 170 removed, the above described battery storage chamber 105 opens to the rear surface section of the housing 100 (refer to FIG. 22 described later).

The functional configuration of the handheld printer 1 will now be described with reference to FIG. 3.

The handheld printer 1 comprises a CPU 12. This CPU 12 performs signal processing in accordance with a program stored in advance in a ROM 14 while utilizing a temporary storage function of an SDRAM 13, and controls the entire handheld printer 1 accordingly.

The CPU 12 is connected to a power supply circuit 15 configured to perform the on/off processing of the power supply of the handheld printer 1, a motor driving circuit 16 configured to control the drive of the drive motor 11 that drives the platen roller 111, and a thermal head control circuit 17 configured to control the drive of the thermal line head 112.

The CPU 12 is connected to a paper detection sensor 18, a feed key 40 for performing a paper feed operation, and a power key 30 for performing a power on/off operation. The CPU 12 detects whether or not the print-receiving paper S has been inserted into the insertion port 104 based on the detection result of the paper detection sensor 18. Further, when the power key 30 or the feed key 40 is pressed, the CPU 12 executes the processing corresponding to the pressed key. That is, when the feed key 40 is pressed, the CPU 12 outputs a control signal to the above described motor driving circuit 16, drives the drive motor 11 to rotate the platen roller 111, and performs feed processing that feeds the print-receiving paper S a predetermined distance. Further, when the power key 30 is pressed with the handheld printer 1 in a power off state, the CPU 12 outputs a control signal to the power supply circuit 15 and performs power-on processing; and when the power key 30 is pressed with the handheld printer in a power on state, the CPU 12 outputs a control signal to the power supply circuit 15 and performs power-off processing.

Note that the above described feed key 40 is operated in a case where paper is to be fed in order to start printing from an intermediate position of the print-receiving paper S in the feeding direction, or in a case where the print-receiving paper S of a length in the feeding direction that is longer than a predetermined length is used and the paper is to be discharged after printing ends, for example.

Further, the CPU 12 is connected to a USB interface driving circuit 21, a wireless communication part 22, and an infrared communication part 23. The USB interface driving circuit 21 controls the communication performed with the above described external device 2 via a USB cable (not shown) connected to a USB terminal 24 (refer to FIG. 1). Further, the wireless communication part 22 controls the wireless communication performed with the above described external device 2 that is based on a radio wave other than infrared. Further, the infrared communication part 23 controls the infrared communication performed with the above described external device 2.

The communication standards of the above described wireless communication and infrared communication are switched as follows. That is, in a case where the above described power key 30 is pressed in a power off state with the above described feed key 40 pressed, the CPU 12 executes power-on processing and switches the communication standards. Accordingly, in a case where the communication standard is wireless communication, the standard is switched to infrared communication when the above described operation is performed; and in a case where the standard is infrared communication, the standard is switched to wireless communication when the above described operation is performed.

With such a configuration, when printing is performed using the handheld printer 1, the operator enters print data to be printed on the print-receiving paper S and enters a print start instruction using the external device 2, such as a PC terminal, handheld telephone, or the like. With this arrangement, the print data is sent from the external device 2 to the handheld printer 1 via the above described USB cable, wireless communication, or infrared communication, and printing is performed by the handheld printer 1 based on the print data.

With the handheld printer 1 of such a basic configuration as described above, the above described power key 30 and feed key 40 are configured with different pressing forces required for operation. A detailed description follows.

The configuration of the power key 30 and the feed key 40 will now be described with reference to FIG. 4 to FIG. 6.

As shown in FIG. 1 previously described, in the handheld printer 1, the above described power key 30 and feed key 40 are centrally provided to a key operation part 106 provided to the upper left side of the top cover 101, and are adjacently disposed. As shown in FIG. 5 and FIG. 6, each of the keys 30 and 40 is respectively configured with key panels 31 and 41, spacers 32 and 42, key electrodes 34 and 44 connected to grounded GND electrodes 33 and 43 and the CPU 12, substrates 35 and 45 made of polyethylene terephthalate (PET), static electricity countermeasure layers 36 and 46 formed by silver for use as a static electricity countermeasure, protective films 37 and 47, and the like, layered in that order from top to bottom.

Figure 4:
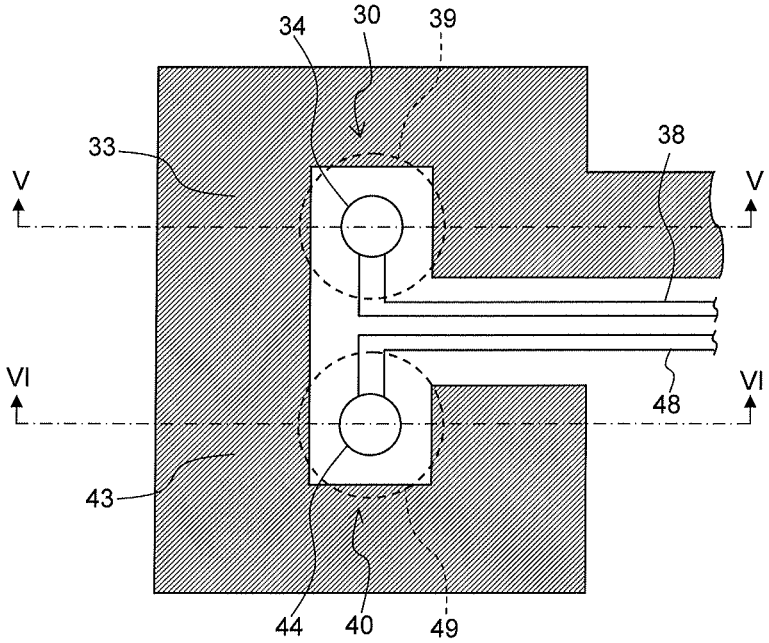
FIG. 4 is a diagram showing a simplified electrode configuration of the power key and feed key.

As shown in FIG. 4, the above described GND electrodes 33 and 43 are integrally formed in a pattern on the substrates 35 and 45, surrounding the circumference of the key electrodes 34 and 44. Further, the key electrodes 34 and 44 are each connected to the CPU 12 by wiring 38 and 48 formed in a pattern on the substrates 35 and 45.

Metal dome members 39 and 49 made of metal and comprising bulging parts 39*a* and 49*a* that bulge in spherical shape toward the side of the key panels 31 and 41 are provided within a space formed by the above described spacers 32 and 42, in the interior of the above described key panels 31 and 41. These metal dome members 39 and 49 utilize the retroflexion of each of the bulging parts 39*a* and 49*a* to apply a reaction force in response to the pressing force of each of the keys 30 and 40. With this arrangement, a click feel is achieved when the operator presses each of the keys 30 and 40, achieving a favorable feeling of operation. Further, the metal dome members 39 and 49 also play the role of contacts that connect the key electrodes 34 and 44 and the GND electrodes 33 and 43 when each of the keys 30 and 40 is pressed.

Figure 5:
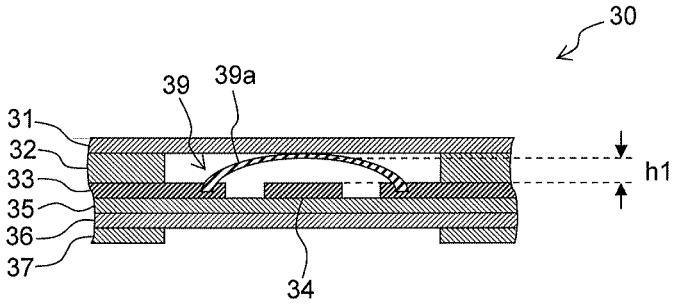
FIG. 5 is a cross-sectional view taken along line V-V in FIG. 4.
Figure 6:
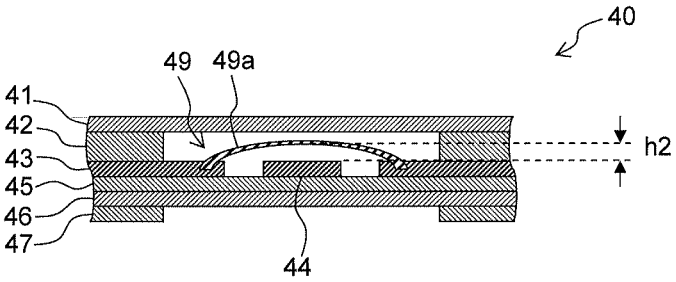
FIG. 6 is a cross-sectional view taken along line VI-VI in FIG. 4.

At this time, as shown in FIG. 5 and FIG. 6, the configuration is designed so that a bulging volume h1 of the bulging part 39*a* of the metal dome member 39 becomes greater than a bulging volume h2 of the bulging part 49*a* of the metal dome member 49. With this arrangement, the metal dome member 39 applies a larger reaction force than the metal dome member 49, necessitating a larger pressing force for operating the power key 30 than that when operating the feed key 40.

The advantages achieved by the above described configuration will now be described with reference to FIG. 7.

Figure 7A:
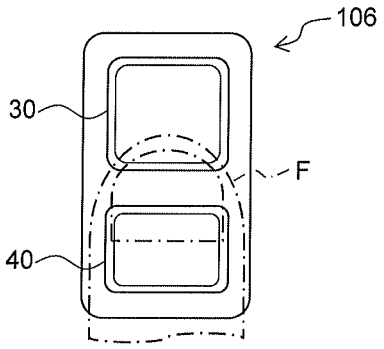
FIGS. 7A and 7B are diagrams for explaining the advantages achieved by making the pressing forces of the power key and feed key different.

In the handheld printer 1, each of the keys 30 and 40 itself is miniaturized to improve the miniaturization of the entire device, and is centrally disposed in one location of the key operation part 106 as previously described in order to improve space efficiency. As a result, as shown in FIG. 7A, the possibility exists that, when pressing the feed key 40, a finger F of the operator may mistakenly touch the adjacent power key 30. At this time, since the operation of the power key 30 requires a larger pressing force than the feed key 40 as previously described, the power key 30 is difficult to press, thereby making it possible to suppress the mistaken operation of the power key 30.

Figure 7B:
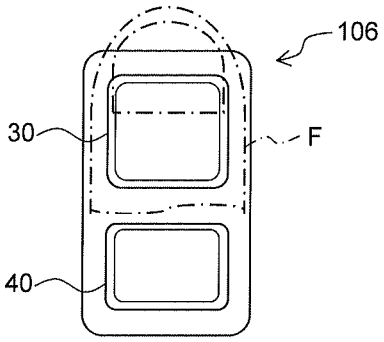

On the other hand, as shown in FIG. 7B, when the operator presses the power key 30, the operator needs to press an accurate position using the finger F since a larger force is required compared to the feed key 40. As a result, the possibility that the adjacent feed key 40 will be touched decreases. In this manner, it is possible to prevent mistaken operation of the adjacently disposed power key 30 and feed key 40.

The control details related to the operation of the power key 30 and the feed key 40 executed by the CPU 12 with the handheld printer 1 in a power on state will now be described with reference to FIG. 8.

In step S10, the CPU 12 determines whether or not the feed key 40 was pressed. In a case where the feed key 40 has not been pressed, the decision is made that the condition is not satisfied and the flow proceeds to step S20. In step S20, the CPU 12 determines whether or not the power key 30 was pressed. In a case where the power key 30 has not been pressed, the decision is made that the condition is not satisfied and the flow returns to the above described step S10.

In a case where the feed key 40 was pressed in the above described step S10, the decision is made that the condition is satisfied and the flow proceeds to step S30. In step S30, the CPU 12 determines whether or not the power key 30 was pressed simultaneously along with the feed key 40. In a case where the power key 30 has not been pressed simultaneously, the decision is made that the condition is not satisfied and the flow proceeds to step S40 where the CPU 12 outputs a control signal to the motor driving circuit 16, drives the drive motor 11 to rotate the platen roller 111, and executes the above described feed processing that feeds the print-receiving paper S a predetermined distance. Then, the flow returns to the above described step S10.

On the other hand, in a case where the power key 30 was simultaneously pressed in the above described step S30, the decision is made that the condition is satisfied and the flow proceeds to step S50 where the CPU 12 outputs a control signal to the power supply circuit 15 and executes power-off processing that turns the power of the handheld printer 1 off. Note that the CPU 12 determines that the condition is satisfied, proceeds to this step S50, and similarly executes power-off processing in a case where the power key 30 was pressed in the above described step S20 as well. Then, this flowchart ends.

With the above control, steps S10 and S20 are repeated during the period in which the operator does not operate either the power key 30 or the feed key 40. At this time, in a case where the power key 30 is singly operated, the decision is made that the condition of step S20 is satisfied and the flow proceeds to step S50 where the above described power-off processing is executed. On the other hand, in a case where the feed key 40 is singly operated, the decision is made that the condition of step S10 is satisfied and the condition of step S30 is not satisfied, and the flow proceeds to step S40 where the above described feed processing is executed.

Further, in a case where the power key 30 and the feed key 40 are simultaneously operated, the decision is made that the conditions of both step S10 and step S30 are satisfied and the flow proceeds to step S50 where power-off processing is executed without executing feed processing. The reason that the processing of the power key 30 is thus executed with priority is that, in a case where the power key 30 and the feed key 40 are simultaneously pressed under conditions where operation of the power key 30 requires a larger pressing force than the feed key 40 as previously described, a larger pressing force was most likely applied to the power key 30, making it possible to infer in this case that the operator pressed the keys with the intention of operating the power key 30. Accordingly, by performing the above described control, it is possible to perform processing conforming to the intention of the operator.

Next, the fixed structure of the guide member 120 previously described will be described with reference to FIG. 9 to FIG. 13. Note that each of the front, rear, left, right, up, and down directions in the following description corresponds to each direction with each part, such as the guide member 120, etc., installed in the handheld printer 1.

Figure 9:
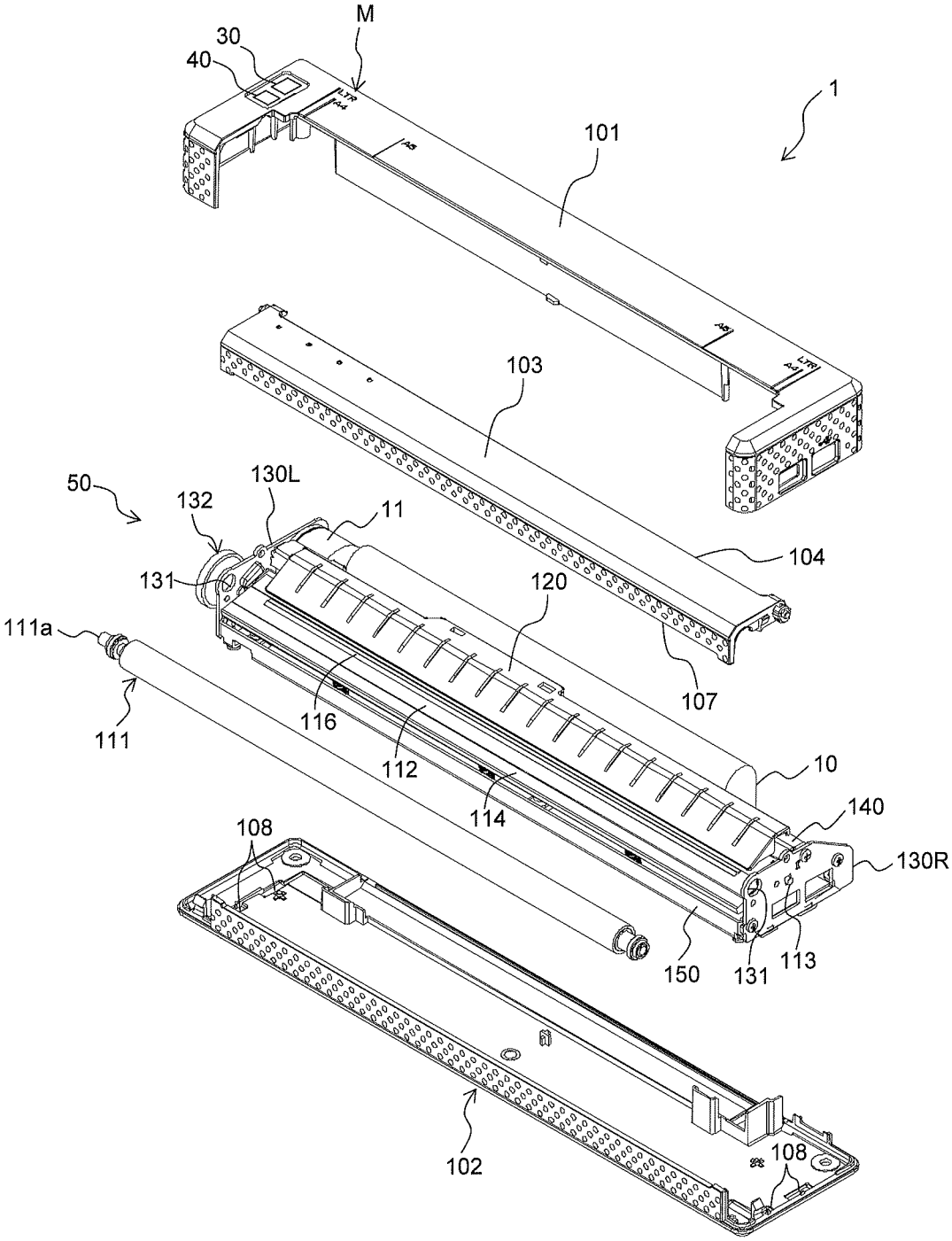
FIG. 9 is an exploded perspective view showing the internal structure of the handheld printer, as viewed obliquely from the front and above.

As shown in FIG. 9, the handheld printer 1 is generally assembled by assembling the top cover 101, the undercover 102, and the cover member 103, which constitute the housing 100, and the chassis assembly 50. The chassis assembly 50 comprises a main chassis member 150 that constitutes the bottom part of the chassis assembly 50 provided on the inner surface of the undercover 102, and the pair of side chassis members 103L and 130R that are arranged in a standing condition from both ends of this main chassis member 150 in a longitudinal direction. The side chassis members 130L and 130R rotatably support the platen roller 111 with a shaft member 111*a* of the platen roller 111 inserted through a shaft hole 131. Further, the side chassis members 130L and 130R rotatably support the heat sink 114 comprising the thermal line head 112 via the shaft member 113 previously described.

The previously described drive motor 11 configured to drive the platen roller 111, and a gear mechanism 132 made of a plurality of gears and configured to transmit the driving force of this drive motor 11 to the above described shaft member 111*a* of the platen roller 111 are provided to the side chassis member 130L on the left side.

Further, a beam member 140 forms a bridge across and is fixed with screws on the upper part of the side chassis members 130L and 130R. Then, the guide member 120 previously described that guides the print-receiving paper S inserted from the insertion port 104 to the pressing part P of the platen roller 111 and the thermal line head 112 is configured as a separate entity separate from the top cover 101, the undercover 102, and the cover member 103 that constitute the housing 100, fixed to the above described beam member 140, and thus provided to the side chassis members 130L and 130R.

Figure 10:
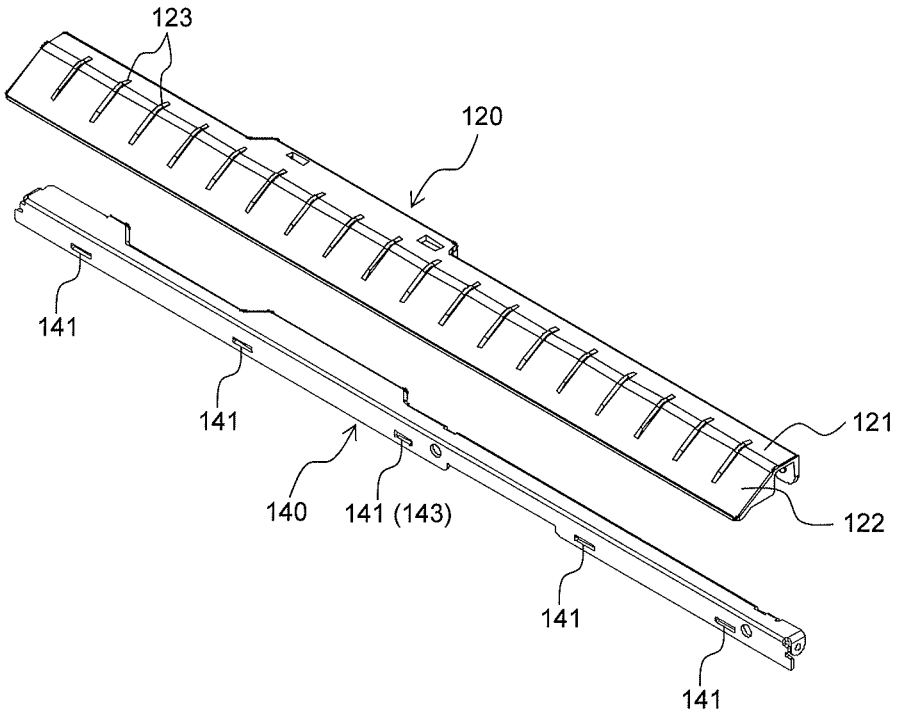
FIG. 10 is a perspective view showing the detailed structure of the guide member and beam member, as viewed obliquely from above.
Figure 11:
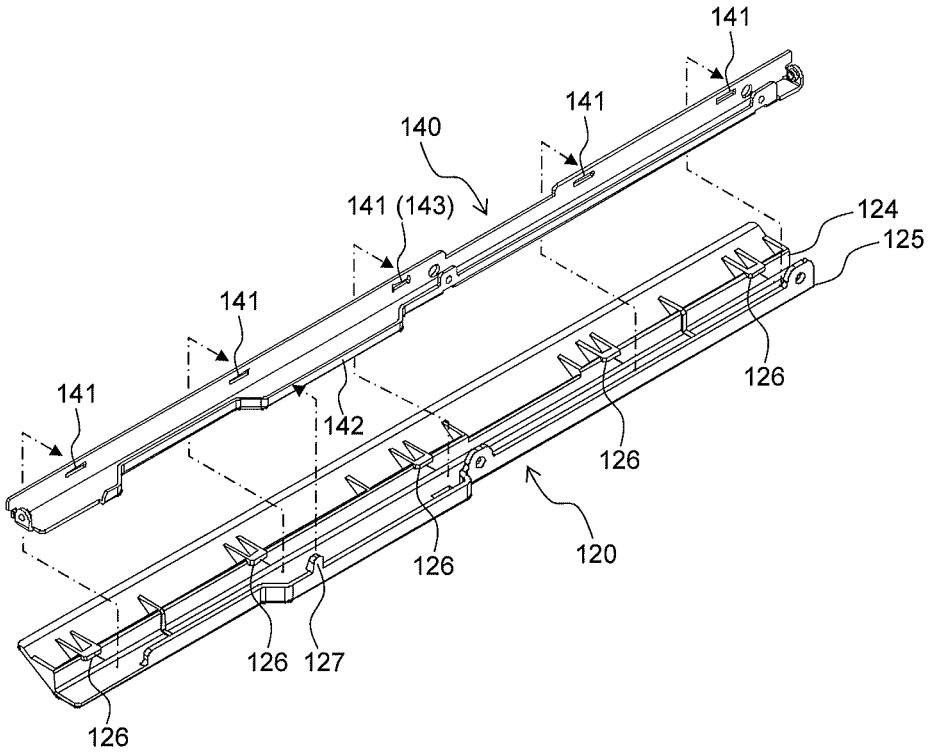
FIG. 11 is a perspective view showing the detailed structure of the guide member and beam member, as viewed obliquely from below.

As shown in FIG. 10 and FIG. 11, the guide member 120 comprises a horizontal surface 121, which is substantially horizontal when assembled to the chassis assembly 50, on the upper part thereof, and an inclined surface 122 that inclines from this horizontal surface 121 toward the device interior. A plurality of protruding members 123 formed along the guided direction of the print-receiving paper S is provided in parallel in the longitudinal direction on the horizontal surface 121 and the inclined surface 122. Further, the guide member 120 comprises rib parts 124 and 125 arranged in a downward standing condition on both sides in the front/rear direction of the lower part of the above described horizontal surface 121. With these rib parts 124 and 125 and the above described horizontal surface 121, the lateral cross-sectional shape of the rear side of the guide member 120 substantially forms an upside-down u-shape, and that section is installed so that it covers the beam member 140 (refer to FIG. 13 described later).

Fixing tab members 126 capable of engaging with a plurality (five in this example) of engaging holes 141 provided to corresponding positions on the front side (the left lower side in FIG. 10; the left upper side in FIG. 11), which is one side of the beam member 140 in a width direction, are provided to a plurality of locations (five in this example) of the above described rib part 124 in a longitudinal direction, protruding to the rear side (the right lower side in FIG. 11). These fixing tab members 126 are formed into the same shape. On the other hand, a hook-shaped hook member 127 capable of locking into a locking part 142 provided to a corresponding position on the rear side (the right lower side in FIG. 11), which is the other side of the beam member 140 in a width direction, is provided to one location of the above described rib part 125 in a longitudinal direction. With this arrangement, the guide member 120 can be fixed by locking the hook member 127 into the locking part 142 on the rear side of the beam member 140 with the above described fixing tab members 126 engaged with the engaging holes 141 on the front side of the beam member 140, and inserting the beam member 140 by the above described fixing tab members 126 and the hook member 127 from both sides in the front/rear direction thereof (refer to FIG. 13 described later). Note that while the above described locking part 142 and the hook member 127 that locks thereto are provided to one location of the beam member 140 in a longitudinal direction and the guide member 120, respectively, they may be provided to a plurality of locations.

Figure 12A:
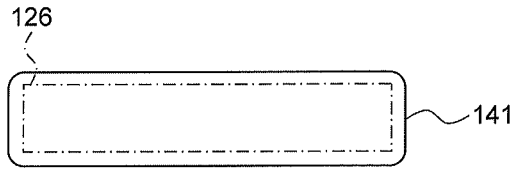
FIGS. 12A and 12B are diagrams showing the shapes of the engaging hole and positioning hole.
Figure 12B:
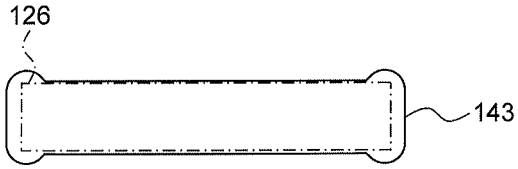

Further, one engaging hole 141 (hereinafter suitably described as the "positioning hole 143") of the above described five engaging holes 141 provided to the beam member 140, positioned at the center in the longitudinal direction, is formed so that the vertical dimension is smaller than the other engaging holes 141, as shown in FIG. 12A and FIG. 12B. The vertical dimension of this positioning hole 143 is substantially the same as the vertical dimension of the fixing tab member 126. With this arrangement, when the fixing tab members 126 of the guide member 120 are engaged with the engaging holes 141 of the beam member 140, the vertical position of the guide member 120 can be positioned by the above described positioning hole 143. Note that while here one of the engaging holes 141 is established as the positioning hole 143, a plurality of the engaging holes 141 may be established as the positioning holes 143.

Figure 13:
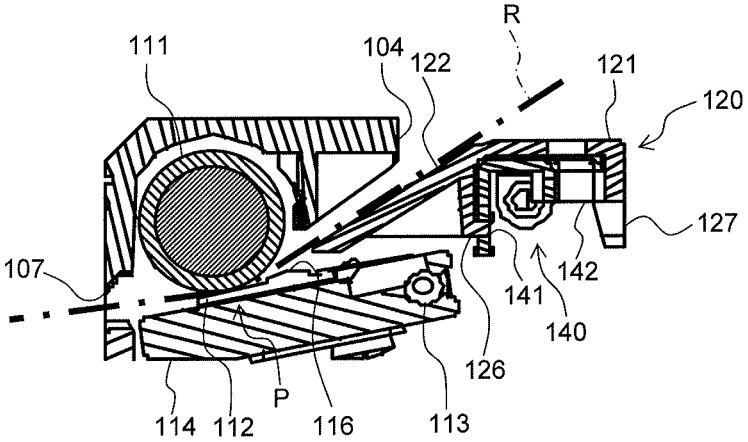
FIG. 13 is a partially enlarged lateral cross-sectional view showing the relative positional relationship of the guide member, platen roller, and thermal line head.

As shown in FIG. 13, the thermal line head 112 comprises an elevated part 116 (refer to FIG. 9 as well) made of resin for protecting the semiconductor element that drives the heating element, on the surface. Here, a feeding path R of the print-receiving paper S is a path from the insertion port 104, through the above described inclined surface 122 of the guide member 120 and the pressing part P of the platen roller 111 and the thermal line head 112, to the discharging exit 107. That is, the feeding path R is demarcated mainly by the relative positional relationship of the guide member 120 with respect to the platen roller 111 and the thermal line head 112. Then, the vertical positioning of the guide member 120 by the positioning hole 143 of the above described beam member 140 is set so that the above described feeding path R can stay clear of the above described elevated part 116. Further, with the guide member 120 fixed to the beam member 140 as previously described, the angle of the inclined surface 122 is set so that the above described feeding path R can stay clear of the elevated part 116. With this arrangement, it possible to prevent the occurrence of defects caused by the print-receiving paper S contacting the above described elevated part 116 of the thermal line head 112 in the feeding path R, such as the impeding of insertion from the insertion port 104 or paper jams.

Next, the energizing structure of the heat sink 114 based on the coil springs 115 provided to the main chassis member 150 will be described with reference to FIG. 14 to FIG. 16. Note that, in FIG. 14, a control substrate 60 is shown in phantom to prevent confusion.

Figure 2:
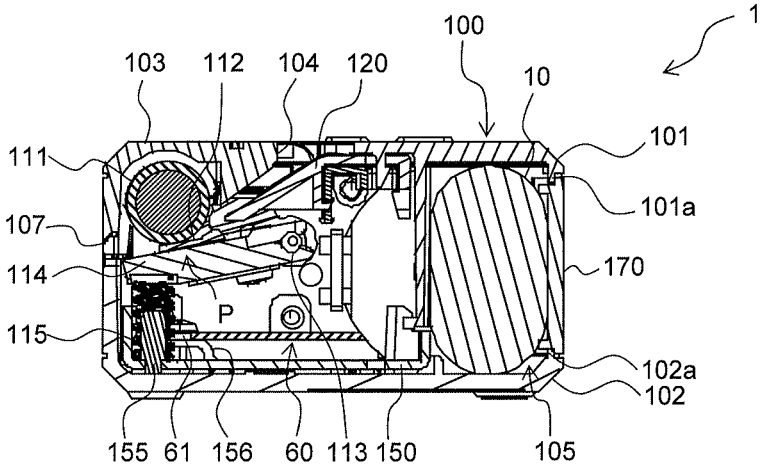
FIG. 2 is a lateral cross-sectional view taken along line II-II in FIG. 1 showing the internal structure of the handheld printer.

As shown in the previously described FIG. 2 and FIG. 9, the main chassis member 150 made of metal constituting the bottom part of the chassis assembly 50 is provided to the inner surface of the undercover 102. As shown in FIG. 14, the main chassis member 150 comprises a front rib part 151 having a substantially L-shaped cross-section that bends upward along the longitudinal direction, at the front (upper left side in FIG. 14) end thereof. Further, the main chassis member 150 comprises a rear rib part 152 having a substantially L-shaped cross-section that similarly bends upward along the longitudinal direction, at the rear (lower right side in FIG. 14) end thereof. The above described front rib part 151 is formed by bending the front end of the main chassis member 150 across the longitudinal direction in its entirety, and the above described rear rib part 152 is formed by bending a center section of the rear end of the main chassis member 150 in a longitudinal direction. Further, the vertical length of the front rib part 151 is configured longer than that of the rear rib part 152.

The above described front rib part 151 comprises a first left fixing part 153 fixed to the left side chassis member 130L, on the left end (right end in FIG. 14), which is one end side in a longitudinal direction; and a first right fixing part 154 fixed to the right side chassis member 130R, on the right end (left end in FIG. 14), which is the other end side in a longitudinal direction. These fixing parts 153 and 154 are formed by bending both ends of the front rib part 151 in a longitudinal direction rearward along the planar direction of the side chassis members 130L and 130R.

Further, a second left fixing part 158 used for fixation with the side chassis member 130L is bent upward and formed at the rear on the left end of the main chassis member 150, and a hook-shaped second right fixing part 159 used for fixation with the side chassis member 130R is bent upward and formed at the rear on the right end of the main chassis member 150.

A plurality (three in this example) of coil springs 115 configured to rotate and energize the heat sink 114 to the platen roller 111 side is provided to a plurality of locations (three in this example) in a longitudinal direction near the above described front rib part 151, on the main chassis member 150. These coil springs 115 are each supported by insertion through a spring support shaft 155 (refer to FIG. 2) provided in a protruding condition to a corresponding position of the main chassis member 150 so that they are stably arranged in a standing condition. The coil springs 115 are provided at equal intervals in three locations of the main chassis member 150 in a longitudinal direction, and comprise a first coil spring 115C provided correspondingly to a center position of the thermal line head 112 in a longitudinal direction, and two second coil springs 115L and 115R positioned on both left and right sides of this first coil spring 115C. Note that, in this description, each of the coil springs 115C, 115L, and 115R is described simply as the "coil spring 115" when distinction is not required.

The spring constant of the first coil spring 115C is greater than the spring constant of the second coil springs 115L and 115R. Since the handheld printer 1 is a printer that feeds and performs printing on the print-receiving paper S using the device center position in a longitudinal direction as standard as indicated by paper alignment position displays M formed on the surface of the top cover 101 (refer to FIG. 1 and FIG. 9), this difference in spring constants is to ensure that the thermal line head 112 is energized by the first coil spring 115C having the largest spring constant at the center position in a longitudinal direction which serves as that standard, and energized by the second coil springs 115L and 115R having the smaller spring constants on both sides thereof, causing the pressing load of the thermal line head 112 to act with good balance and achieve stability in the longitudinal direction, even if the size of the print-receiving paper S is changed.

Figure 14:
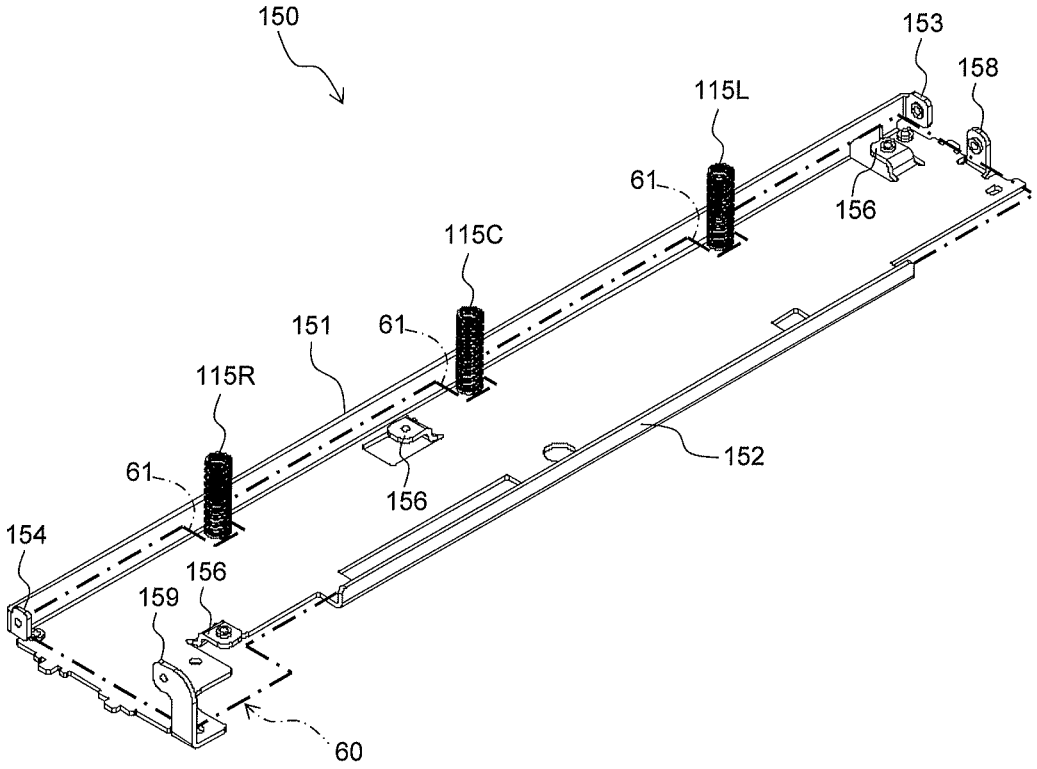
FIG. 14 is a perspective view showing the detailed structure of the main chassis member.

Further, as shown in FIG. 2 and FIG. 14 previously described, in the handheld printer 1, the control substrate 60 on which electronic devices are mounted is provided between the main chassis member 150 and the heat sink 114 that supports the thermal line head 112. This control substrate 60 is inserted between the front rib part 151 and the rear rib part 152 previously described, and installed by screws (not shown) to a plurality (three in this example) of installation parts 156 cut and formed from the main chassis member 150. A plurality (three in this example) of concave parts 61 for inserting the coil springs 115 is provided to positions corresponding to the coil springs 115 on the peripheral edge of this control substrate 60.

Figure 15:
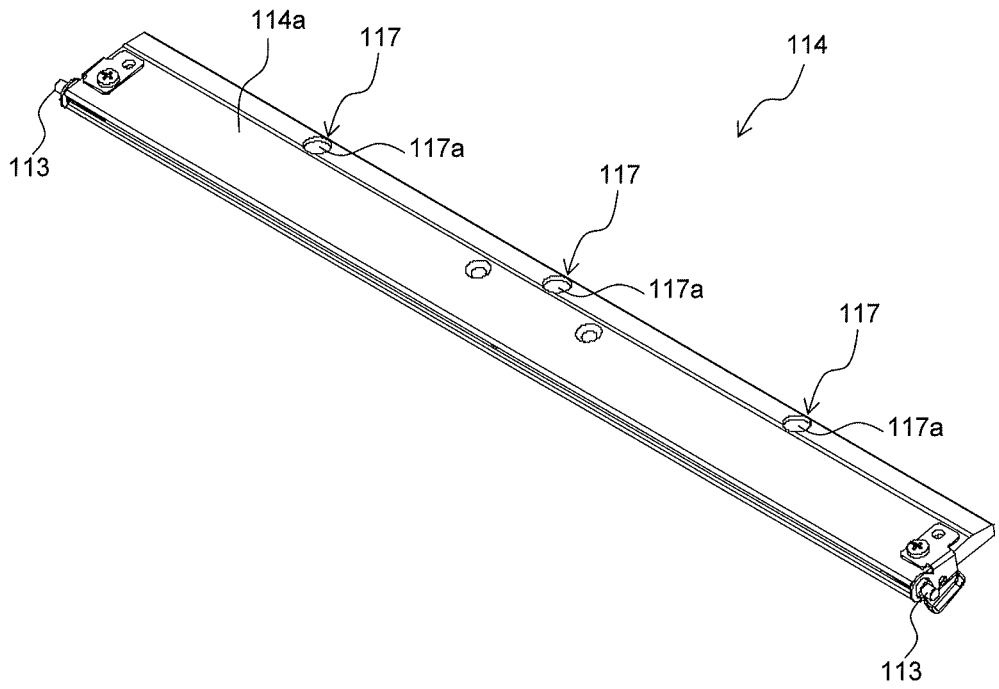
FIG. 15 is a perspective view showing the detailed structure of the heat sink, as viewed obliquely from below.

As shown in FIG. 15, concave-shaped spring receiving parts 117 are provided to positions corresponding to the above described coil springs 115, on a lower surface 114*a* of the heat sink 114 on the opposite side of the thermal line head 112 side. This spring receiving part 117 comprises at the bottom thereof a contact surface 117*a* configured to contact the upper end of the coil spring 115 and, as shown in FIG. 16, is provided so that, even in a case where the posture is such that a planar direction X of the heat sink 114 is not orthogonal to an axial direction Y of the coil spring 115 due to the rotational movement around the shaft member 113, the above described contact surface 117*a* is substantially orthogonal to the above described axial direction Y. With this arrangement, the upper end of each of the coil springs 115 is caused to contact the above described contact surface 117*a* of the corresponding spring receiving part 117, making it possible to cause an energizing force to stably act on the heat sink 114.

Figure 16:
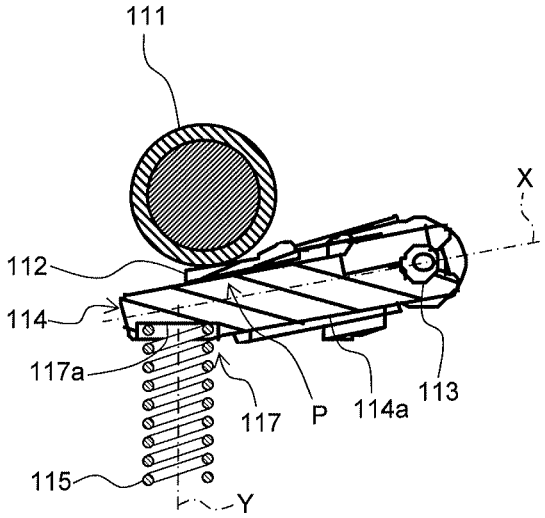
FIG. 16 is a lateral cross-sectional view of the heat sink showing the structure of the spring receiving part.

Further, as shown in FIG. 16, the spring receiving part 117 is provided to the front (left side in FIG. 16) end of the heat sink 114, which is the other end in a width direction. That is, the coil spring 115 is configured so that the heat sink 114 is energized to the platen roller 111 side, further frontward than the position of the pressing part P of the thermal line head 112 and the platen roller 111. With this arrangement, it is possible to decrease the required energizing force compared to a case where energizing occurs at a middle position of the heat sink 114, between the rear end and front end, particularly further rearward than the pressing part P, thereby improving miniaturization of the coil spring.

Next, the fixed structure of the side chassis members 130 and the main chassis member 150 will be described with reference to FIG. 17 and FIG. 18. Note that, in these FIGS. 17 and 18, illustration of the guide member 120 is omitted.

Figure 17:
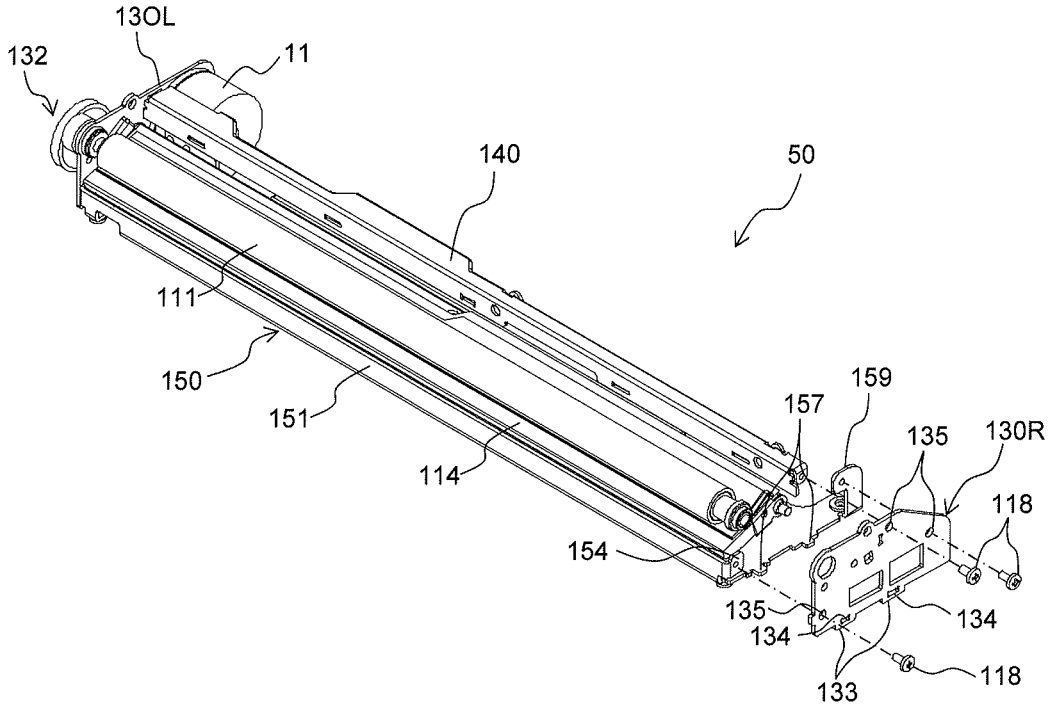
FIG. 17 is an exploded perspective view of the chassis assembly showing the fixed structure of the side chassis members and main chassis member.
Figure 18:
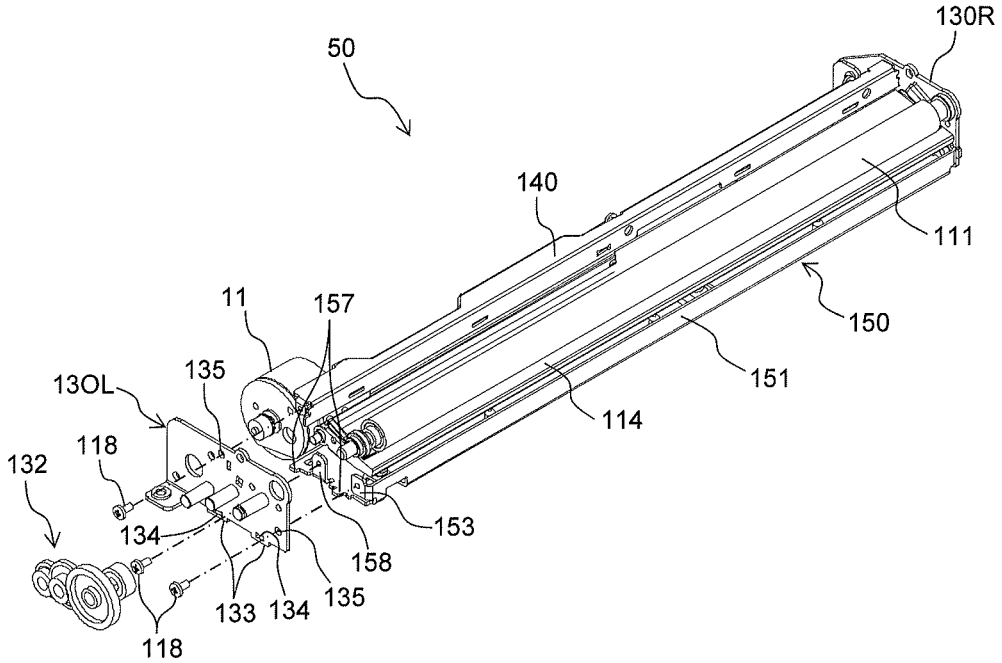
FIG. 18 is an exploded perspective view of the chassis assembly showing the fixed structure of the side chassis members and main chassis member.

As shown in FIG. 17 and FIG. 18, a convex part 133 is provided in two front/rear-direction locations to each of the base ends, which are the lower ends of the side chassis members 130L and 130R. These convex parts 133 are formed in order to provide engaging holes 134 described later to the base ends of the side chassis members 130L and 130R. Note that these convex parts 133 are each housed within a concave part 108 (refer to FIG. 9) provided on the inner surface of the undercover 102 when the undercover 102 and the chassis assembly 50 are assembled.

The engaging hole 134 with which a protruding part 157 provided to both ends of the main chassis member 150 in a longitudinal direction engages is formed on each of the above described convex parts 133 of the side chassis members 130L and 130R. With each of the protruding parts 157 engaged with the corresponding engaging hole 134, the base ends of the side chassis members 130L and 130R are positioned at both end positions of the main chassis member 150 in a longitudinal direction.

A screw hole 135 through which is inserted one of a plurality (three in this example) of connecting screws 118 is respectively provided to the side chassis members 130L and 130R. The screws 118 are inserted through the above described screw holes 135 of the side chassis members 130L and 130R, thereby connecting the first left fixing part 153 and the first right fixing part 154 of the above described front rib part 151, both ends of the above described beam member 140 in a longitudinal direction, and the above described second left fixing part 158 and second right fixing part 159 provided at the rear of the main chassis member 150. With this arrangement, the side chassis members 130L and 130R are fixed to the main chassis member 150. The chassis assembly 50 thus configured is assembled to the undercover 102 while each of the above described convex parts 133 of the side chassis members 130L and 130R is caused to be housed in the above described concave parts 108 of the undercover 102.

As a result, the base ends of the side chassis members 130L and 130R are positioned at both end positions of the main chassis member 150 in a longitudinal direction by the protruding parts 157 of the main chassis member 150, and the left side chassis member 130L and the right side chassis member 130R are connected at a middle position between the base ends and the providing part of the platen roller 111 or the thermal line head 112 by the front rib part 151 of the main chassis member 150.

Next, the buffering structure of the chassis assembly 50 of the handheld printer 1 will be described with reference to FIG. 19 to FIG. 21.

Figure 19:
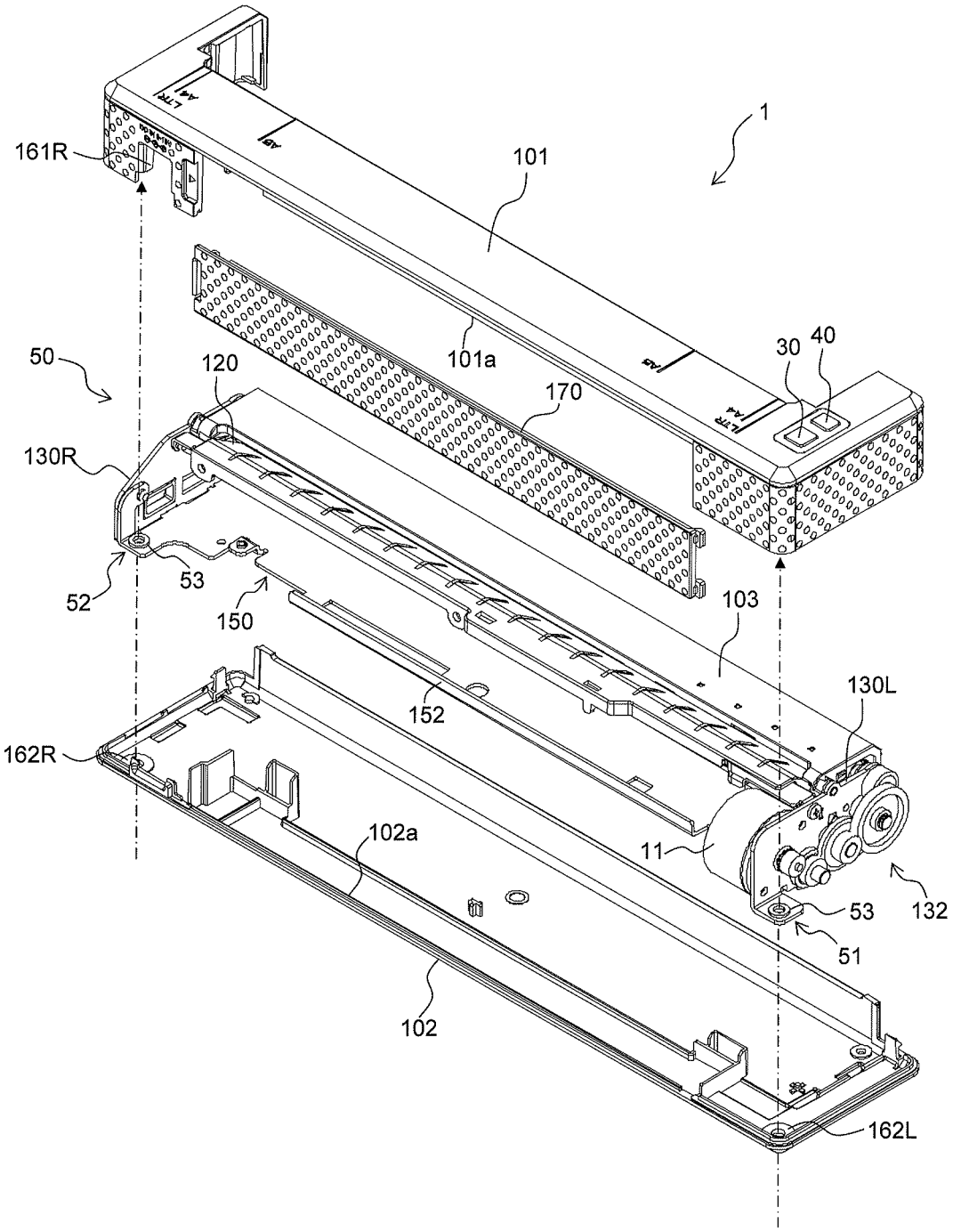
FIG. 19 is an exploded perspective view showing the internal structure of the handheld printer, as viewed obliquely from the rear and above.
Figure 20:
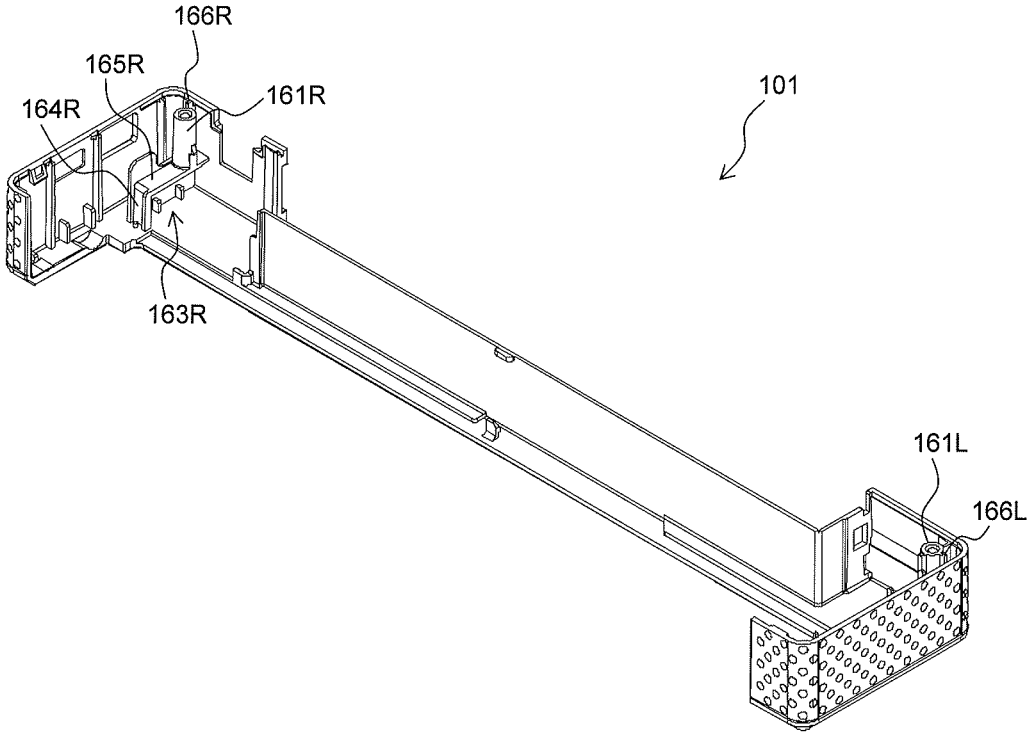
FIG. 20 is a perspective view showing the detailed structure of the inside of the top cover.
Figure 21:
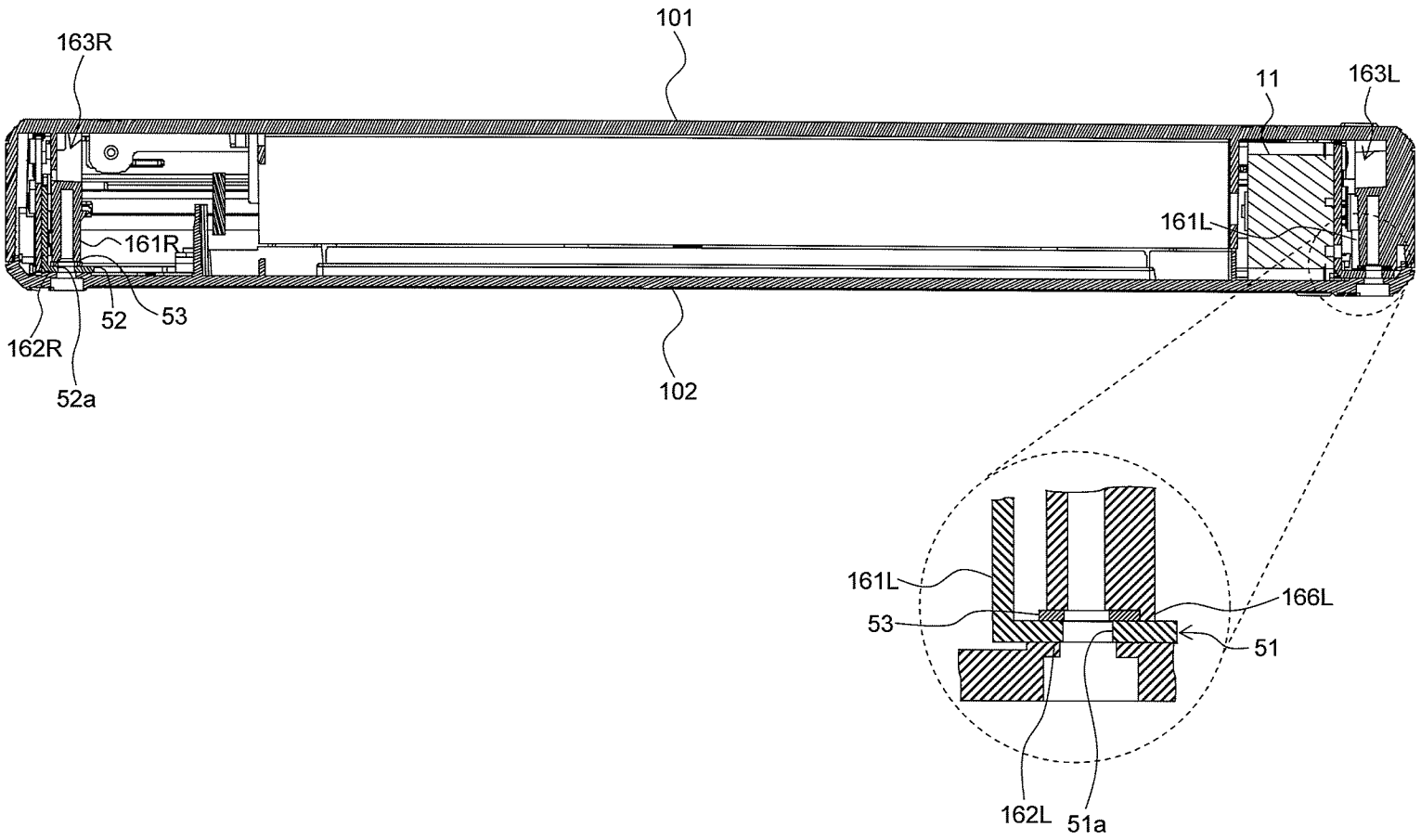
FIG. 21 is a cross-sectional view of the handheld printer showing the structure near the first boss part and the second boss part.

As shown in FIG. 20, first boss parts 161L and 161R configured to protrude toward the device inside are provided to the inside of the top cover 101, at both width-direction ends of the rear side thereof (upper right side in FIG. 20). A screw groove (not shown) is formed on the inner peripheral surface of these first boss parts 161L and 161R. On the other hand, as shown in FIG. 19, second boss parts 162L and 162R configured to slightly protrude toward the device inside are provided to the inside of the undercover 101, at both width-direction ends of the rear side thereof (lower left side in FIG. 19).

Further, as shown in FIG. 19, the chassis assembly 50 comprises installation parts 51 and 52 where screw holes 51*a* and 52*a* (refer to FIG. 21) are formed at both width-direction ends of the rear side thereof. The above described installation part 51 is formed by bending the rear side of the base end of the side chassis member 130L toward the width-direction outside (lower right side in FIG. 19). Further, the above described installation part 52 is integrally provided at the rear on the right side of the main chassis part 150. A spherical rubber member 53 is provided to each of the upper parts of these installation parts 51 and 52.

The first boss parts 161L and 161R of the above described top cover 101, the installation parts 51 and 52 of the chassis assembly 50, the rubber members 53 and 53 respectively provided to the upper parts of these installation parts 51 and 52, and the second boss parts 162L and 162R of the undercover 101 are each provided to corresponding positions in the vertical direction. Then, the top cover 101, the undercover 102, and the chassis assembly 50 are assembled to each other by inserting the screws (not shown) inserted from the second boss parts 162L and 162R of the undercover 102 through the screw holes 51*a* and 52*a* of the installation parts 51 and 52 of the chassis assembly 50 and the rubber members 53 and 53, and connecting the screws to the first boss parts 161L and 161R of the top cover 101.

In this manner, when the top cover 101, the undercover 102, and the chassis assembly 50 are assembled, the installation parts 51 and 52 of the chassis assembly 50 are inserted between the first boss parts 161L and 161R of the top cover 101 and the second boss parts 162L and 162R of the undercover 102. At this time, for the chassis assembly 50 and the undercover 102, contact is made at the installation parts 51 and 52 and the second boss parts 162L and 162R while the base ends of the side chassis member 130 previously described are not in contact with the inner surface of the undercover 102. On the other hand, for the chassis assembly 50 and the top cover 101, only the installation parts 51 and 52 and the first boss parts 161L and 161R are indirectly in contact via the rubber member 53 provided therebetween. With this arrangement, the impact transmitted from the top cover 101 to the chassis assembly 50 can be effectively absorbed by the rubber member 53.

Further, the top cover 101 comprises boss support members 163L and 163R (only the boss support member 163R is shown in FIG. 20) configured to support the first boss parts 161L and 161R so that the impact transmitted from the cover to the first boss parts 161L and 161R can be absorbed. As shown in FIG. 20, the boss support member 163R comprises a standing part 164R arranged in a standing condition from the upper rear side of the top cover 101 toward the device inside, and a bending part 165R provided bending from this standing part 164R, with the first boss part 161R provided on the above described bending part 165R. Note that the boss support member 163L also has the same structure as the above described boss support member 163R. With such a structure, the boss support members 163L and 163R are capable of absorbing the impact transmitted from the top cover 101 to the first boss parts 161L and 161R by the flexure that occurs between the standing parts 164L and 164R and the bending parts 165L and 165R.

Further, as shown in FIG. 20, the top cover 101 comprises rib parts 166L and 166R configured to protrude a predetermined distance further toward the device inside (upper side in FIG. 20) than the tip parts of the first boss parts 161L and 161R, around the first boss parts 161L and 161R. The above described rib part 166L is arranged on the width-direction outside of the first boss part 161L (the right lower side in FIG. 20; the right side in FIG. 21), and the above described rib part 166R is arranged on the rear side (upper right side in FIG. 20) of the first boss part 161R. Note that only the rib part 166L is shown in FIG. 21 based on the cross-sectional direction. The tips of these rib parts 166L and 166R contact the installation parts 51 and 52 of the chassis assembly 50 when the top cover 101, the undercover 102, and the chassis assembly 50 are assembled, restricting the movement of the first boss parts 161L and 161R toward the installation part 51 and 52 side. With this arrangement, the amount of compression of the rubber member 53 is prevented from becoming excessive, thereby preventing decreases in the buffering function and durability of the rubber member 53.

Next, the structure of the battery chamber cover 170 detachable from the battery storage chamber 105 will be described with reference to FIG. 22 to FIG. 25.

Figure 22:
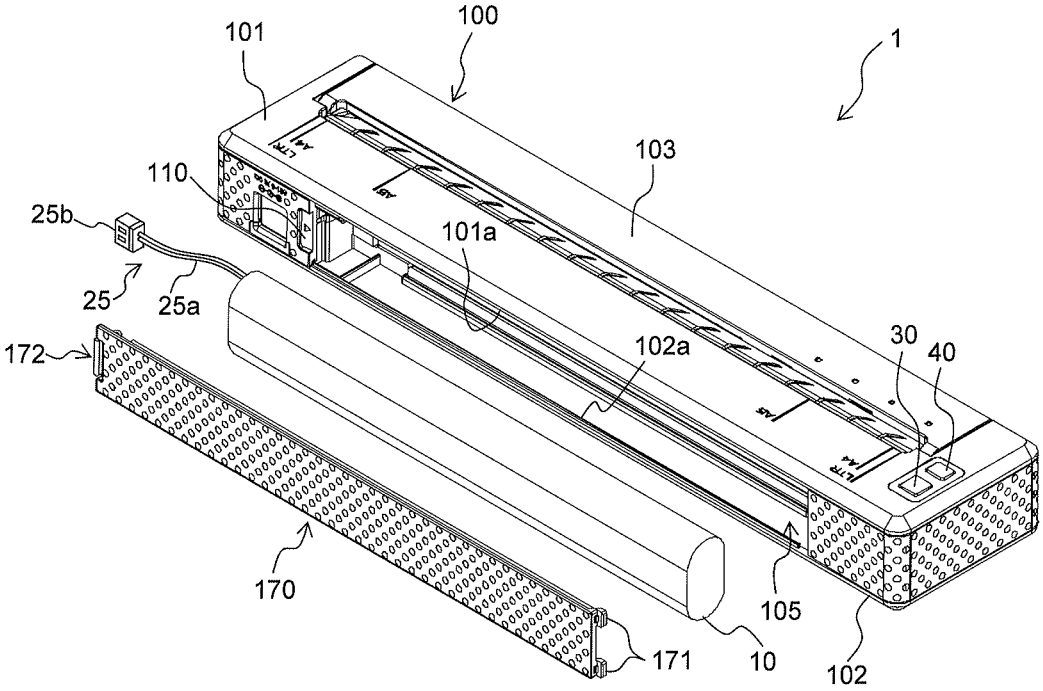
FIG. 22 is a perspective view showing the battery storage chamber opened with the battery chamber cover removed, viewing the handheld printer obliquely from the rear and above.

As previously described, the battery chamber cover 170 is detachably provided to the battery storage chamber 105 and, as shown in FIG. 22, the battery storage chamber 105 configured to store the rechargeable battery 10 opens to the rear surface section of the housing 100 with the battery chamber cover 170 removed.

Figure 23:
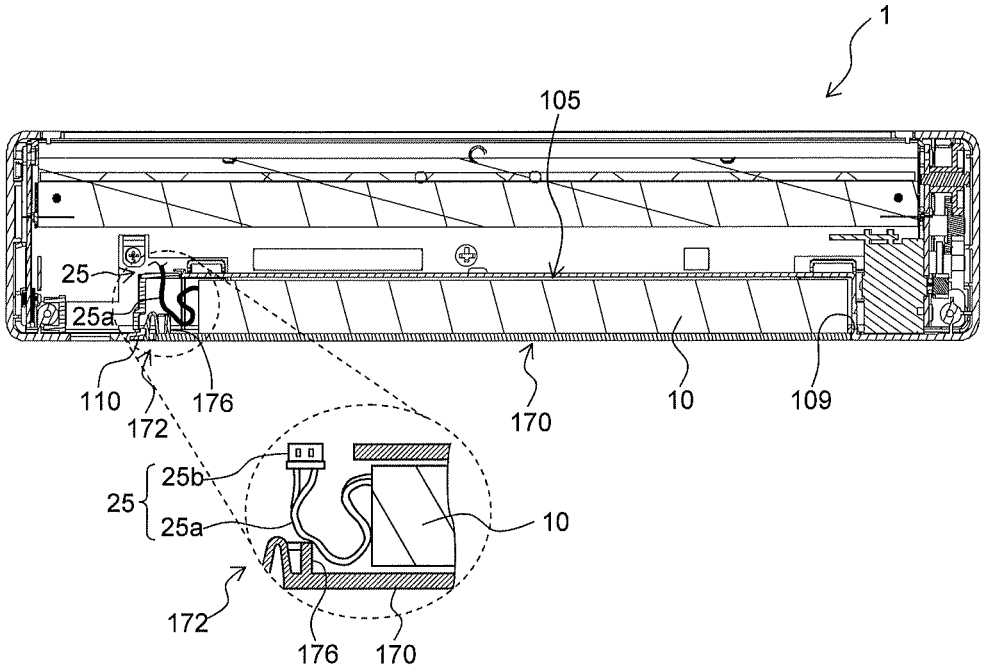
FIG. 23 is a horizontal cross-sectional view of the handheld printer.

The battery chamber cover 170 comprises at the left end (right end in FIG. 22 to FIG. 25), which is one end thereof in a longitudinal direction, an upper/lower pair of the locking tabs 171 that fit into a locking hole 109 (refer to FIG. 23) provided to the left end, which is one end in a longitudinal direction, of the battery storage chamber 105. Further, the battery chamber cover 170 comprises at the right end (left end in FIG. 22 to FIG. 25), which is the other end in a longitudinal direction, an elastic engaging part 172 that elastically deforms and engages with an engaged part 110 provided to the right end, which is the other end in a longitudinal direction, of the battery storage chamber 105. When the battery chamber cover 170 is mounted onto the battery storage chamber 105, the above described locking tabs 171 of the left end are first fit into the above described locking holes 109 of the battery storage chamber 105 to lock the left end and, in that state, the right end is pressed into the battery storage chamber 105, thereby elastically deforming and then engaging the elastic engaging part 172 with the above described engaged part 110 of the battery storage chamber 105. With this arrangement, the battery chamber cover 170 is mounted onto the battery storage chamber 105, as shown in FIG. 23.

On the other hand, when the battery chamber cover 170 is removed from the battery storage chamber 105, the operator inserts a finger into the above described engaged part 110 formed into a concave shape and elastically deforms the above described elastic engaging part 172, thereby disengaging the elastic engaging part 172 and the engaged part 110. Then, the operator pulls the locking tabs 171 from the locking holes 109 of the battery storage chamber 105, removing the battery chamber cover 170 from the battery storage chamber 105.

Figure 24:
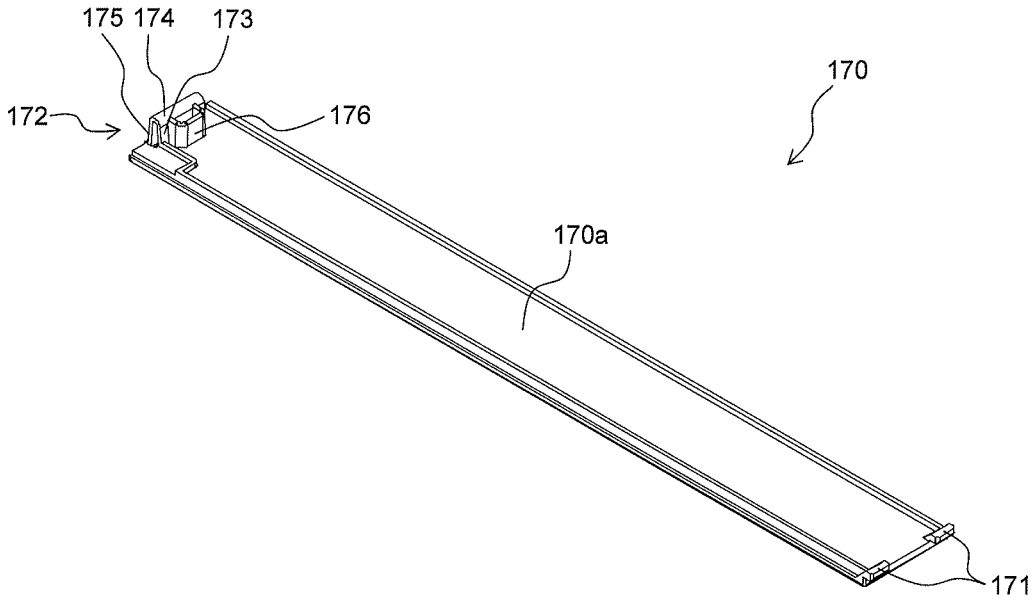
FIG. 24 is a perspective view showing the detailed structure of the battery chamber cover, as viewed obliquely from the left and above.
Figure 25:
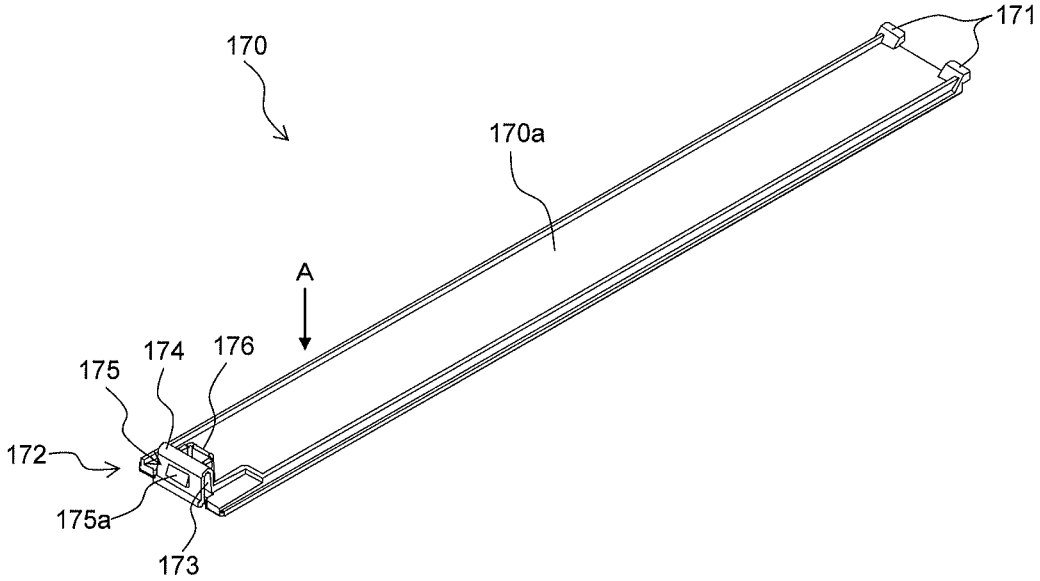
FIG. 25 is a perspective view showing the detailed structure of the battery chamber cover, as viewed obliquely from the right and above.

As shown in FIG. 24 and FIG. 25, the elastic engaging part 172 comprises a support part 173 that is arranged in a standing condition from an inner surface 170*a* of the battery chamber cover 170 toward the battery storage chamber 105 side, a curving part 174 provided to the tip of this support part 173, and the tip part 175 capable of moving toward and away from the above described support part 173 by the flexure of this curving part 174. A protruding part 175*a* is formed on the tip part 175, and this protruding part 175*a* engages with the engaged part 110 of the battery storage chamber 105.

Further, a rib part 176 adjacent to the above described support part 173 of the elastic engaging part 172 is arranged in a standing condition on the inner surface 170*a* of the battery chamber cover 170. This rib part 176 comprises a hollow structure having a cross-section of a substantially sideways u-shape that opens to the left, with the open side connected to the above-described support part 173. As shown in FIG. 23, the rib part 176 functions as a harness pressing part that presses an electric cable 25*a* of a harness 25 connected to the stored rechargeable battery 10 when the battery chamber cover 170 is mounted onto the battery storage chamber 105. That is, the harness 25 for supplying power to the device is connected to the rechargeable battery 10, on the right end (left end in FIG. 23) which serves as the other side end thereof, when stored in the battery storage chamber 105. This harness 25 comprises a connector 25*b* connected to the control substrate 60 previously described, etc., and a plurality (two in this example) of the electric cables 25*a* consolidated into a bundle. These electric cables 25*a* are formed longer in length to allow leeway, taking into consideration detachability during battery replacement. As a result, as shown in FIG. 23, when the rechargeable battery 10 is stored in the battery storage chamber 105, the electric cables 25*a* are looped back within the battery storage chamber 105. The rib part 176 presses the looped back section of the looped back electric cables 25*a* toward the storage chamber far side, making it possible to prevent interference of the looped back section with the elastic engaging part 172.

In the handheld printer 1 of this embodiment, the metal dome member 39 of the power key 30 is configured to apply a larger reaction force than the metal dome member 49 of the feed key 40. As a result, to operate the power key 30, a pressing force that is larger than that when operating the feed key 40 is required. With this arrangement, as shown in FIG. 7A, even if the operator mistakenly touches the adjacent power key 30 when pressing the feed key 40, the power key 30 is difficult to press, making it possible to suppress mistaken operation of the power key 30. As a result, the power of the device is not mistakenly turned off when the feed key 40 is operated, making it possible to normally execute the feed operation. On the other hand, when the operator presses the power key 30, a relatively large force is required, causing the need to press an accurate position to arise and, as a result, a decrease in the possibility of touching the adjacent feed key 40, as shown in FIG. 7B. Accordingly, it is possible to prevent the mistaken operation of the adjacently disposed power key 30 and the feed key 40.

Further, as in this embodiment, since the configuration is one wherein the size of the reaction force applied to each of the keys 30 and 40 is adjusted, it is possible to prevent the mistaken operation of flat-shaped keys as well in comparison to a case where the mistaken operation of adjacent keys is prevented by designing each of the keys 30 and 40 with a convex surface shape, for example. Accordingly, this configuration is advantageous with a handheld electronic device which demands miniaturization and portability. Further, in a case where each of the keys 30 and 40 is made convex in shape as described above, while the contact surface area of the key surface and operator finger significantly decreases, resulting in the concern of a decrease in operability as well as a significant impact on the outer appearance of the device, a resolution can be made according to this embodiment without changing the surface shape of each of the keys 30 and 40, making it possible to eliminate such above described concern and impact.

Further, in particular, according to this embodiment, in a case where the power key 30 and the feed key 40 are simultaneously operated with the power of the handheld printer 1 in an on state, the power key 30 is regarded as having been pressed and the CPU 12 performs power-off processing. That is, in a case where the power key 30 and the feed key 40 are simultaneously pressed with the operation of the power key 30 requiring a larger pressing force than the feed key 40 as in this embodiment, a larger pressing force was most likely applied to the power key 30. Accordingly, in this case, it can be inferred that the operator pressed the keys with the intention of operating the power key 30. As a result, the power key 30 is processed with priority as described above, making it possible to perform processing conforming to the intention of the operator.

Further, in particular, according to this embodiment, operation of the power key 30 requires a larger pressing force than the feed key 40. In this state, operating the power key 30 with a larger pressing force while pressing the feed key 40 with just a small pressing force requires less operation labor and is easier than the reverse. Thus, according to this embodiment, the switching of the communication standards of the handheld printer 1 and the external device 2 is assigned as the preset function to such an operation and, in a case where the above described operation is performed with the power in an off state, power-on processing as well as the set switching of the communication standards are executed. With this arrangement, it is possible to execute the switching of the communication standard preferred at power-on using a simple operation, thereby improving user friendliness.

Further, in particular, according to this embodiment, the metal dome members 39 and 49 are used in response to the pressing force of the power key 30 and the feed key 40. Then, the configuration is designed so that the bulging volume h1 of the bulging part 39*a* of the metal dome member 39 is made greater than the bulging volume h2 of the bulging part 49*a* of the metal dome member 49, making the metal dome member 39 apply a larger reaction force than the metal dome member 49. The bulging volume of each of the bulging parts 39*a* and 49*a* can be easily adjusted by adjusting the punching force when performing punch processing on a metal sheet to form each of the metal dome members, making it possible to achieve a configuration where the metal dome member 39 applies a larger reaction force than the metal dome member 49 based on a simple manufacturing process. Furthermore, a metal member such as the metal dome members 39 and 49 are used, therefore the metal dome members 39 and 49 themselves can be used as electrode contacts, making it possible to simplify the key structure and contact comprise separate members.

Further, the handheld printer 1 of this embodiment described above offers the following advantages. That is, the harness 25 for supplying power to the device is connected to the rechargeable battery 10. This harness 25 comprises a plurality of electric cables 25*a* consolidated into a bundle. These electric cables 25*a* are formed longer in length to allow leeway, taking into consideration detachability at the time of battery replacement, and are therefore looped back within the battery storage chamber 105 when the rechargeable battery 10 is stored in the battery storage chamber 105. For this reason, in a case where the harness 25 is positioned at the right end of the battery storage chamber 105 as in this embodiment, the possibility exists that the looped back section of the electric cables 25*a* will interfere with the elastic engaging part 172 of the battery chamber cover 170, impeding elastic deformation thereof and preventing smooth mounting of the battery chamber cover 170 onto the battery storage chamber 105.

Here, according to this embodiment, the rib part 176 configured to press the electric cables 25*a* of the harness 25 is provided near the elastic engaging part 172. With this arrangement, when the battery chamber cover 170 is mounted onto the battery storage chamber 105, the looped back section of the electric cables 25*a* of the harness 25 is pressed toward the storage chamber far side by the rib part 176, making it possible to prevent the looped back section from interfering with the elastic engaging part 172. As a result, the battery chamber cover 170 can be smoothly mounted onto the battery storage chamber 105.

Further, in particular, according to this embodiment, the elastic engaging part 172 comprises the support part 173 arranged in a standing condition from the inner surface 170*a* of the battery chamber cover 170 toward the inside of the battery storage chamber 105, the curving part 174 provided to the tip of the support part 173, and the tip part 175 that engages with the engaged part 110 while moving toward and away from the support part 173 by the flexure of the curving part 174, and is designed with a configuration that elastically deforms by the flexing movement of the above described curving part 174. Then, the rib part 176 is adjacently provided to the support part 173, causing the support part 173 of the elastic engaging part 172 to be securely fixed to the inner surface 170*a* of the battery chamber cover 170. In this manner, the structure of the elastic engaging part 172 is designed so that the curving part 174 and the tip part 175 elastically deform with respect to the fixed support part 173, making it possible to decrease the impact on elastic movement when the looped back section of the harness electric cables 25*a* contacts the rib part 176 and the support part 173 in comparison to a structure in which the entire elastic engaging part 172 elastically deforms, thereby making it possible to suppress the interference of the loop backed section with the elastic engaging part 172. Further, the support part 173 of the elastic engaging part 172 can be securely fixed by the rib part 176, resulting in the advantage of improving the strength of the elastic engaging part 172 as well.

Further, in particular, according to this embodiment, the rib part 176 comprises a hollow structure having a substantially sideways u-shaped cross-section that opens to the left, with the open side connected to the support part 173 of the elastic engaging part 172. With such a hollow structure, the looped back section of the harness electric cables 25*a* can be reliably pressed toward the storage chamber far side, and the weight can be reduced more than that of a solid structure.

Further, in the handheld printer 1 of this embodiment described above, the rubber member 53 is provided between the first boss parts 161L and 161R of the top cover 101 and the installation parts 51 and 52 of the chassis assembly 50. With this arrangement, in a case where the handheld printer 1 is subjected to high impact when dropped, etc., it is possible to absorb the impact transmitted from the top cover 101 to the chassis assembly 50 by the rubber member 53. As a result, the occurrence of a defect in the platen roller 111 and thermal line head 112 as a result of impact can be suppressed, making it possible to achieve a handheld printer with high impact resistance when dropped, etc.

Further, in particular, according to this embodiment, the top cover 101 comprises the rib members 166L and 166R around the first boss parts 161L and 161R, restricting the movement of the first boss parts 161L and 161R toward the installation part 51 and 52 side as the tips of the rib members 166L and 166R contact the installation parts 51 and 52 of the chassis assembly 50. That is, since the rubber member 53 used as an impact absorbing material has the property that its buffering function and durability are decreased when excessively compressed, the provision of the above described rib members 166L and 166R makes it possible to prevent the first boss parts 161L and 161R from moving toward the installation part 51 and 52 side more than necessary, thereby making it possible to prevent the compression of the rubber member 53 from becoming excessive. Accordingly, it is possible to prevent decreases in the buffering function and durability of the rubber member 53.

Further, in particular, according to this embodiment, the top cover 101 comprises the boss support members 163L and 163R configured to support the first boss parts 161L and 161R. The boss support members 163L and 163R comprise the standing parts 164L and 164R arranged in a standing condition on the upper surface of the top cover 101, and the bending parts 165L and 165R provided bending from the standing parts 164L and 164R, with the first boss parts 161L and 161R provided on the bending parts 165L and 165R. With this arrangement, the boss support members 163L and 163R are configured to be capable of absorbing the impact transmitted from the top cover 101 to the first boss parts 161L and 161R by the flexure that occurs between the standing parts 164L and 164R and the bending parts 165L and 165R. As a result, the impact transmitted from the top cover 101 to the chassis assembly 50 can be absorbed by not only the rubber member 53 but also the boss support members 163L and 163R, thereby further improving the impact durability when the device is dropped, etc.

Further, in particular, according to this embodiment, the rubber member 53 is provided between the first boss parts 161L and 161R of the top cover 101 and the installation parts 51 and 52, and not provided between the second boss parts 162L and 162R of the undercover 102 and the installation parts 51 and 52. This is because, with the handheld printer 1, the top cover 101 covers the major section of the upper and side surfaces of the device contour, and the undercover 102 mainly covers only the lower surface of the device contour, resulting in a configuration in which the top cover 101 covers the major section of the device contour. In this case, there is a high possibility that the top cover 101 that covers the major section of the device contour will be subjected to impact when the handheld printer 1 is dropped, etc. Accordingly, as in this embodiment, the rubber member 53 is provided between the first boss parts 161L and 161R of the top cover 101 and the installation parts 51 and 52, making it possible to effectively absorb an impact transmitted to the chassis assembly 50. Further, this makes it possible to decrease the number of parts compared to a case where the rubber member 53 is provided between both the first boss parts 161L and 161R and the second boss parts 162L and 162R and the installation parts 51 and 52.

Further, the handheld printer 1 of this embodiment described above is capable of offering advantages such as the following. That is, in a general handheld printer, the platen roller and thermal line head (including the heat sink, etc.) supported by the side chassis members include metal as a component, and are therefore relatively heavy parts among the parts of the handheld printer. As a result, in a case where the handheld printer is subjected to high impact when dropped, etc., the possibility exists that the pair of side chassis members will deform by opening with respect to one another due to the inertia of the above described heavy objects, causing the platen roller and the thermal line head to separate from the side chassis members.

In this embodiment, the base ends of the side chassis members 130L and 130R are positioned at both end positions of the main chassis member 150 in a longitudinal direction by the protruding parts 157 provided to both ends of the main chassis member 150 in a longitudinal direction, and the left side chassis member 130L and the right side chassis member 130R are connected at a middle position between the base ends of the side chassis members 130L and 130R and the providing part of the platen roller 111 or the thermal line head 112 by the front rib part 151 of the main chassis member 150. With this arrangement, the spacing of the base ends of the side chassis members 130L and 130R is fixed to the length of the main chassis member 150 in a longitudinal direction, and the spacing of the middle position between the base ends and the providing part of the platen roller 111 or thermal line head 112 positioned thereabove is also fixed to the length of the main chassis member 150 in a longitudinal direction by the front rib part 151.

Since the spacing of the side chassis members 130L and 130R can thus be fixed at two vertical locations, i.e., at the base end and the position thereabove, it is possible to suppress deformation where the pair of side chassis members 130L and 130R opens with respect to one another due to the inertia of heavy objects, such as the platen roller 111 and thermal line head 112, etc., even in a case where the handheld printer 1 is subjected to high impact when dropped, etc., as previously described. As a result, separation of the platen roller 111 and the thermal line head 112 from the side chassis members 130L and 130R can be suppressed, making it possible to achieve a handheld printer with high impact resistance when dropped, etc. Further, the configuration is designed so that the main chassis member 150 integrally comprises the protruding parts 157 and the front rib part 151, making it possible to decrease the number of parts without requiring separate provision of members for positioning and connecting the side chassis members 130L and 130R.

Further, in particular, according to this embodiment, the configuration is designed so that the left side chassis member 130L and the right side chassis member 130R are connected by the front rib part 151 of a cross-sectional L-shape that was formed by bending the front end of the main chassis member 150 along the longitudinal direction toward the disposed side of the platen roller 111 and the thermal line head 112. That is, since the side chassis members 130L and 130R can be connected by simply bending the main chassis member 150, manufacturing is easy and the structure of the handheld printer 1 can be simplified. Furthermore, the front rib part 151 is formed on the main chassis member 150, making it possible to increase the strength of the main chassis member 150 itself and design a structure that is even more resistant to the impact that occurs when the handheld printer 1 is dropped, etc.

Further, in particular, according to this embodiment, both ends of the front rib part 151 in a longitudinal direction are respectively bent along the planar direction of the side chassis members 130L and 130R, forming the first left fixing part 153 and the first right fixing part 154. With this arrangement, the first left fixing part 153 and the first right fixing part 154 can be made substantially parallel with the planar direction of the side chassis members 130L and 130R, making it possible to securely and stably fix both fixing parts 153 and 154 to the side chassis members 130L and 130R with the screws 118.

Further, in particular, according to this embodiment, the protruding parts 157 provided to both ends of the main chassis member 150 in a longitudinal direction engage with the engaging holes 134 provided to the base ends of the side chassis members 130L and 130R, positioning the base ends of the side chassis members 130L and 130R at both end positions of the main chassis member 150 in a longitudinal direction. With such a structure, it is possible to readily position the base ends of the side chassis members 130L and 130R at both end positions of the main chassis member 150 in a longitudinal direction based on a simple structure.

Further, in the handheld printer 1 of this embodiment described above, the guide member 120 is configured as a separate entity separate from the top cover 101, the undercover 102, and the cover member 103 that constitute the housing 100, and is provided to the side chassis members 130L and 130R along with the platen roller 111 and thermal line head 112. With the platen roller 111, the thermal line head 112, and the guide member 120 respectively thus provided to the side chassis members 130L and 130R, integral configuration thereof as the chassis assembly 50 is possible. With this arrangement, the relative positional accuracy of the guide member 120 with respect to the platen roller 111 and the thermal line head 112 in relation to the demarcation of the feeding path R of the print-receiving paper S can be improved, regardless of the assembly accuracy of the top cover 101, the undercover 102, the cover member 103, and the chassis assembly 50 during assembly of the handheld printer 1. This makes it possible to prevent the occurrence of defects caused by the print-receiving paper S contacting an obstacle in the feeding path R, such as the impeding of insertion from the insertion port 104 or paper jams.

Further, in particular, according to this embodiment, the beam member 140 forms a bridge across the pair of side chassis members 130L and 130R, and the guide member 120 is fixed to the beam member 140 and thus provided to the side chassis members 130L and 130R. With such a configuration, the guide member 120 can be reliably fixed to the side chassis members 130L and 130R, making it possible to reliably improve the relative positional accuracy of the guide member 120 with respect to the platen roller 111 and the thermal line head 112. Further, compared to a structure in which the guide member 120 is directly provided to the side chassis members 130L and 130R by screws, etc., the guide member 120 can be readily assembled.

Further, in particular, according to this embodiment, the guide member 120 comprises the fixing tab members 126 in a plurality of locations in the longitudinal direction, which respectively engage with engaging holes 141 provided to corresponding positions on the front side of the beam member 140, fixing the guide member 120 to the beam member 140. With such a structure where a plurality of the fixing tab members 126 engages with the engaging holes 141, it is possible to securely fix the guide member 120 to the beam member 140.

Further, in particular, according to this embodiment, the beam member 140 comprises among the plurality of engaging holes 141 one positioning hole 143 having a smaller vertical dimension than the other engaging holes 141. With this arrangement, when the fixing tab members 126 of the guide member 120 are engaged with the engaging holes 141 of the beam member 140, the vertical position of the guide member 120 can be positioned by the positioning hole 143.

Further, in particular, according to this embodiment, the guide member 120 comprises the hook-shaped hook member 127 in one location in the longitudinal direction, which locks into the locking part 142 provided to a corresponding position on the rear side of the beam member 140, with the fixing tab members 126 engaged with the engaging holes 141 (including the positioning hole 143) on the front side of the beam member 140 as previously described, thereby fixing the guide member 120 to the beam member 140. With this arrangement, the beam member 140 can be inserted by the fixing tab members 126 and the hook member 127 from both front/rear-direction sides thereof, making it possible to reliably fix the guide member 120 to the beam member 140 while positioning the vertical position thereof.

Further, in particular, according to this embodiment, the elevated part 116 made of resin for protecting the semiconductor element that drives the heating element is provided to the surface of the thermal line head 112. Then, the angle of the inclined surface 122 of the guide member 120 is configured so that the feeding path R that connects the pressing part P of the platen roller 111 and the thermal line head 112 is capable of staying clear of the elevated part 116 of the above described thermal line head 112, and the positioning holes 141 of the beam member 140 vertically position the guide member 120 so that the feeding path R is capable of staying clear of the elevated part 116. With this arrangement, it possible to prevent the occurrence of defects caused by the print-receiving paper S contacting the elevated part 116 in the feeding path R, such as the impeding of insertion from the insertion port 104 or paper jams.

Further, in the handheld printer 1 of this embodiment described above, the coil spring 115 is provided to the main chassis member 150 that is made of metal and provided on the inner surface of the undercover 102. With the main chassis member 150 made of metal, strength is increased. Further, by providing the front rib part 150 of a cross-sectional L-shape bent along the longitudinal direction near the provided position of the coil spring 115 of the main chassis member 150, the strength in response to the reaction force of the coil spring 115 is further improved. With this arrangement, even if the reaction force of the coil spring 115 acts on a plurality of locations in a longitudinal direction, the occurrence of deformation, such as the flexure of the main chassis member 150 in the longitudinal direction, etc., can be prevented, making it possible to suppress variance in the pressing load of the thermal line head 112 caused by the deformation.

Further, use of a plurality of the coil springs 115 to energize the thermal line head 112 to the platen roller 111 side makes it possible to suppress the variance in the spring performance in comparison to a case where plate springs, which are susceptible to variance in individual spring performance due to a difference in residual stress when the springs are formed, a difference in the level of metal fatigue caused by use, and the like, are used. Accordingly, the variance in the pressing load of the thermal line head 112 caused by variance in spring performance can be suppressed.

Further, in particular, according to this embodiment, the control substrate 60 comprising at the peripheral edge the plurality of concave parts 61 for inserting the coil springs 115 is arranged between the main chassis member 150 and the heat sink 114 that supports the thermal line head 112. With this arrangement, in a printer configuration where the control substrate 60 is positioned between the main chassis member 150 and the heat sink 114, a plate spring no longer needs to be used to stay clear of the control substrate 60, making it possible to achieve a structure in which coil springs, which are not susceptible to variance in individual spring performance, are used. Further, with a configuration in which the concave parts 61 are provided to the peripheral edge of the control substrate 60 for insertion of the coil springs 115 at the outer periphery, it is possible to reduce corrosion of the mounting surface area of the electronic devices of the control substrate 60 compared to a case where insertion holes are provided to the control substrate 60 for insertion of the coil springs 115 at the inner periphery.

Further, in particular, according to this embodiment, the spring support shaft 155 is provided in a protruding condition to the main chassis member 150, and inserted through the coil spring 115, thereby supporting the coil spring 115. With this arrangement, the coil spring 115 can be stably supported in a standing condition, and positioned in a predetermined energizing position.

Further, in particular, according to this embodiment, the upper end of the coil spring 115 contacts the contact surface 117*a* of the concave spring receiving part 117 provided to the heat sink 114, energizing the heat sink 114 to the platen roller 111 side. At this time, the contact surface 117*a* of the spring receiving part 117 is formed so that it is orthogonal to the axial direction Y thereof when contacting the coil spring 115, causing the contact surface 117*a* that contacts the upper end of the coil spring 115 to be held orthogonal to the axial direction Y, even in a case where the posture is not orthogonal to the axial direction Y of the coil spring 115 when in contact with the coil spring 115 due to the rotational movement of the planar direction 1 of the heat sink 114 around the shaft member 113. With this arrangement, the energizing force of the coil spring 115 can stably act on the heat sink 114. Further, with the structure designed so that the coil spring 115 directly contacts the heat sink 114, the heat of the thermal line head 112 can also be transferred from the heat sink 114 to the coil spring 115 and the main chassis member 150 made of metal, resulting in the advantage of the capability of heat radiation as well.

Further, in particular, according to this embodiment, the spring receiving part 117 of the heat sink 114 is provided to the front end which is further frontward than the position of the pressing part P of the platen roller 111 in the front/rear direction of the heat sink 114. With the structure thus designed so that energizing is performed by the coil spring 115 on the front end opposite to the rear end which serves as the rotational center of the heat sink 114, it is possible to decrease the required energizing force compared to a case where energizing is performed at a middle position of the front end and rear end, enabling miniaturization of the coil spring 115. Further, the coil spring 115 can be disposed on the outer peripheral side of the device, making it possible to decrease the surface area of the concave part 61 provided to the control substrate 60.

Further, in particular, according to this embodiment, the coil spring 115 that energizes the thermal line head 112 to the platen roller 111 side comprises three coil springs disposed at equal intervals, i.e., the one first coil spring 115C provided correspondingly to the center position of the thermal line head 112 in a longitudinal direction, and the two second coil springs 115L and 115R having a smaller spring constant than the first coil spring 115C and positioned on both sides of the first coil spring 115C. With this arrangement, in a case where the handheld printer 1 is a printer that feeds and performs printing on the print-receiving paper S using the center position of the device in a longitudinal direction as standard as in this embodiment, the thermal line head 112 is energized by the first coil spring 115C having the largest spring constant at the center position in a longitudinal direction which serves as that standard, and energized at both sides by the second coil springs 115L and 115R having the smaller spring constant, causing the pressing load of the thermal line head 112 to act with good balance and achieve stability in the longitudinal direction, even if the size of the print-receiving paper S is changed.

Note that the present disclosure is not limited to the above described embodiment, and various modifications may be made without deviating from the spirit and scope of the disclosure. The following describes such modifications one by one.

(1) When the Feed Key is Prioritized when Keys are Simultaneously Operated

While the power key 30 is processed with priority in a case where the power key 30 and the feed key 40 are simultaneously operated according to the above described embodiment, the present disclosure is not limited thereto, allowing prioritization of the feed key 40.

Figure 26:
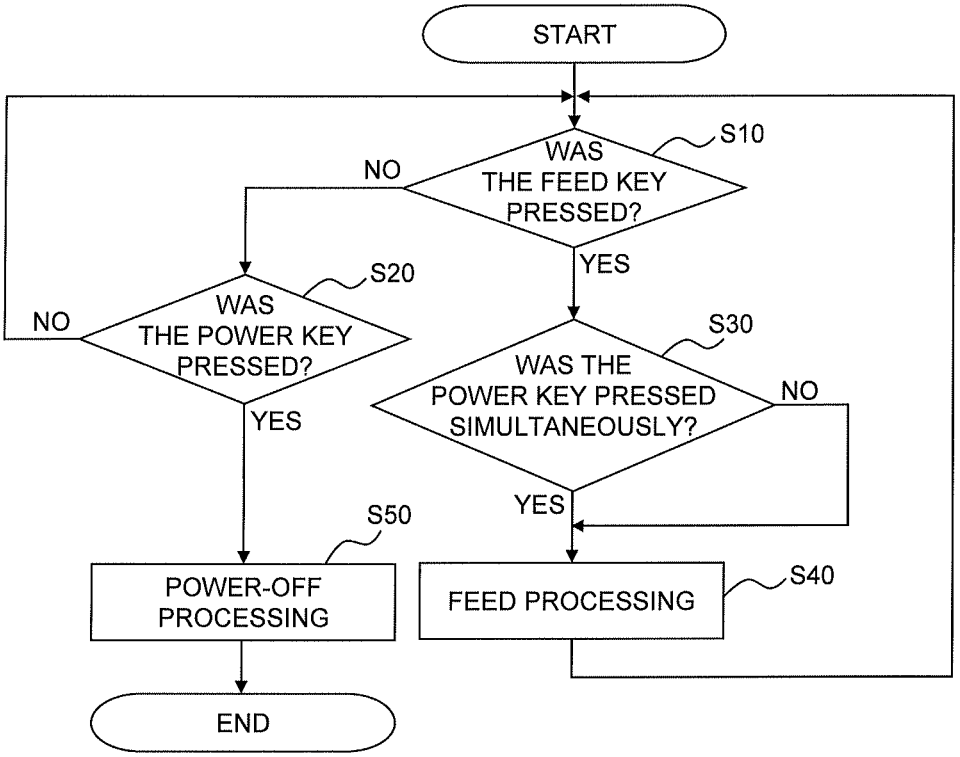
FIG. 26 is a flowchart showing the control details related to the operation of the power key and feed key executed by the CPU in a modification where the feed key is prioritized when the keys are simultaneously operated.

The control details related to the operation of the power key 30 and the feed key 40 executed by the CPU 12 in this modification will now be described with reference to FIG. 26.

Figure 8:
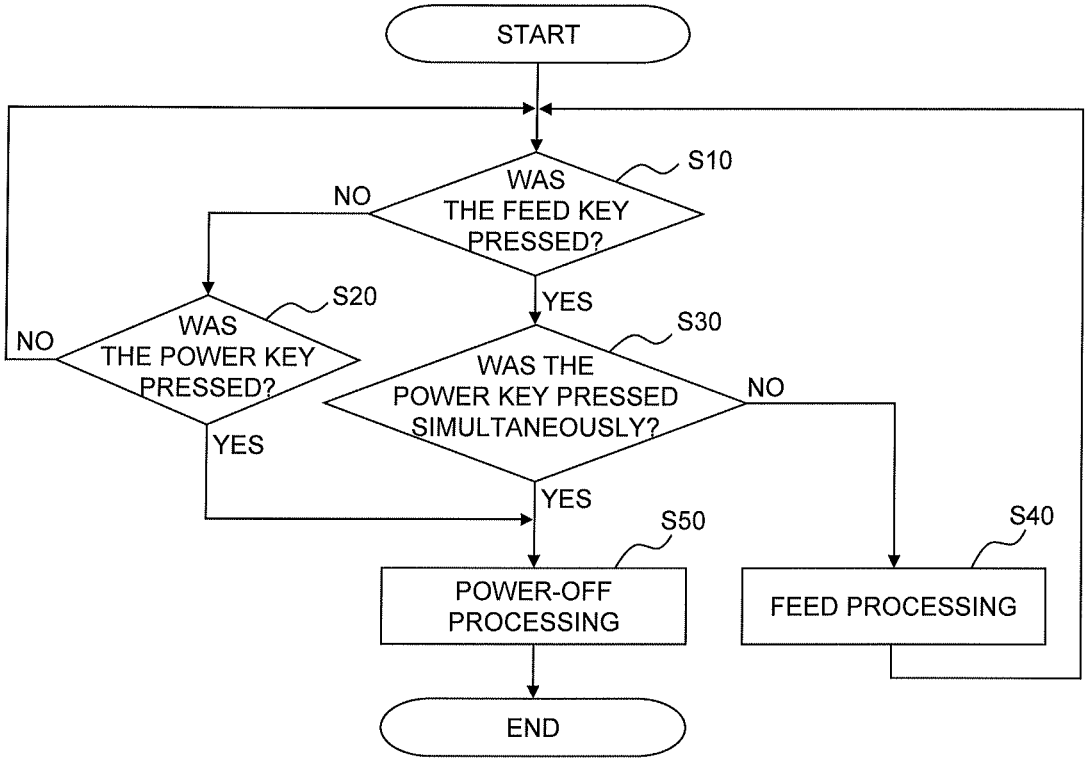
FIG. 8 is a flowchart showing the control details related to the operation of the power key and feed key executed by the CPU with the power of the handheld printer in an on state.

Steps S10, S20, and S50 are the same as those in FIG. 8 previously described. That is, steps S10 and S20 are repeated during the period in which the operator does not operate either the power key 30 or the feed key 40. At this time, in a case where the power key 30 is singly operated, the decision is made that the condition of step S20 is satisfied and the flow proceeds to step S50 where the above described power-off processing is executed.

On the other hand, in a case where the feed key 40 is operated during the period in which steps S10 and S20 are repeated, the flow proceeds to step S30 where the CPU 12 determines whether or not the power key 30 was simultaneously pressed along with the feed key 40. At this time, in both cases where the power key 30 was either simultaneously pressed or not pressed, the flow proceeds to step S40 where the CPU 12 executes the above described feed processing. Then, the flow returns to the above described step S10.

As described above, according to this modification, in a case where the power key 30 and the feed key 40 are simultaneously operated, feed processing is executed without executing power-off processing. With the processing of the feed key 40 executed with priority in this manner, even if the operator mistakenly applies a larger pressing force to the power key 30 when operating the feed key 40, thereby simultaneously pressing the power key 30 and feed key 40, feed processing is executed, making it possible to further increase the function of suppressing mistaken operation of the power key 30.

(2) When the Power Key is Operated by Double-Clicking

While operation of the power key 30 and the feed key 40 is performed by pressing the key once according to the above described embodiment, the present disclosure is not limited thereto, allowing the power key 30 to be regarded as operated and power-off processing to be performed only when the key is pressed twice in a row within a predetermined period of time.

Figure 27:
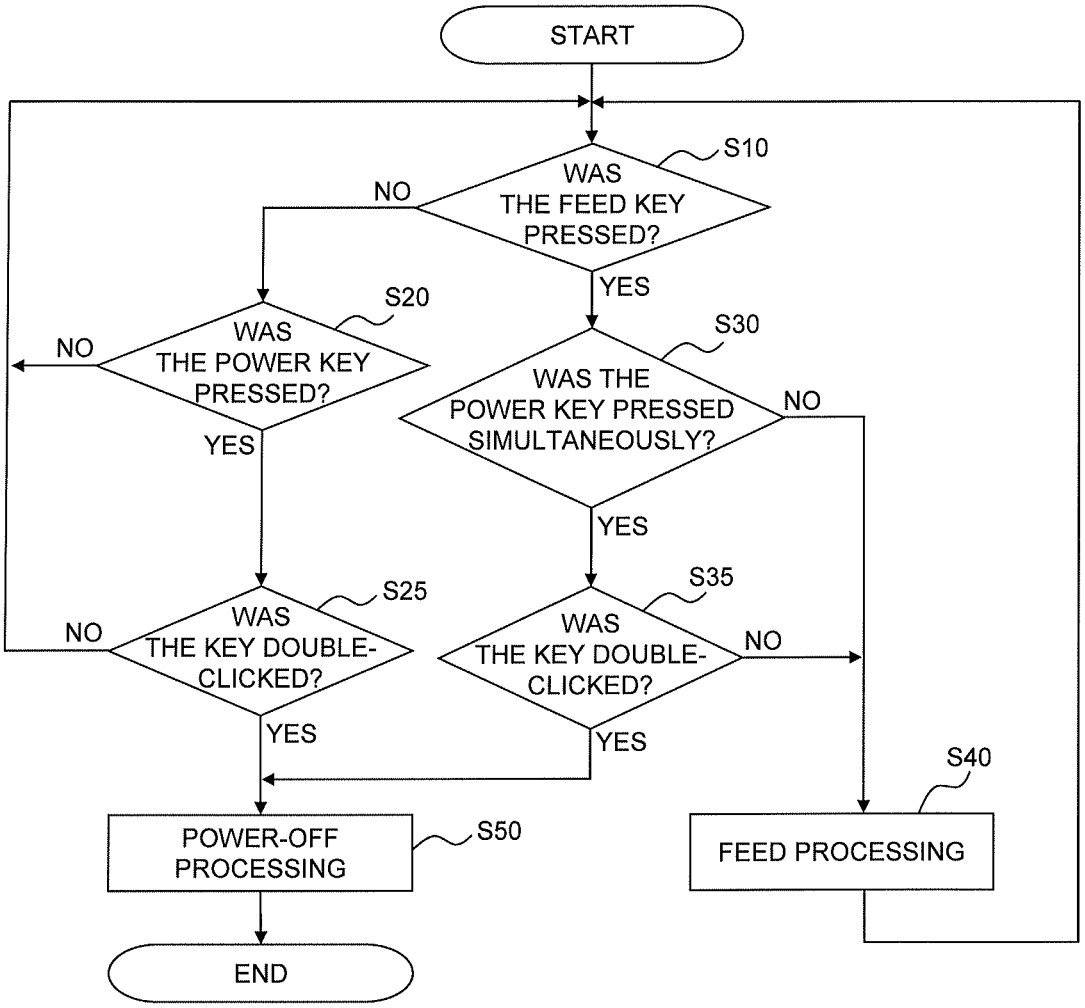
FIG. 27 is a flowchart showing the control details related to the operation of the power key and feed key executed by the CPU in a modification where the power key is operated by double-clicking.

The control details related to the operation of the power key 30 and the feed key 40 executed by the CPU 12 in this modification will now be described with reference to FIG. 27.

Steps S10 and S20 are the same as those in FIG. 8 previously described, and are repeated during the period in which the operator does not operate either the power key 30 or the feed key 40. At this time, in a case where the power key 30 is singly operated, the decision is made that the condition of step S20 is satisfied and the flow proceeds to step S25.

In step S25, the CPU 12 determines whether or not the power key 30 was pressed twice in a row within a predetermined period of time (hereinafter described as "double-clicked"). In a case where the power key 30 has not been double-clicked, the decision is made that the condition is not satisfied and the flow returns to step S10. On the other hand, in a case where the power key 30 was double-clicked, the decision is made that the condition is satisfied and the flow proceeds to step S50 where the CPU 12 executes power-off processing. This flow then terminates here.

On the other hand, in a case where the feed key 40 is operated during the period in which steps S10 and S20 (or steps S10 to S30) are repeated, the decision is made that the condition of step S10 is satisfied and the flow proceeds to step S30 where the CPU 12 determines whether or not the power key 30 was simultaneously pressed along with the feed key 40. In a case where the power key 30 has not been simultaneously pressed, the decision is made that the condition is not satisfied and the flow proceeds to step S40 where the CPU 12 executes the above described feed processing. Then, the flow returns to the above described step S10. On the other hand, in a case where the power key 30 was simultaneously pressed, the decision is made that the condition is not satisfied and the flow proceeds to step S35.

In step S35, the CPU 12 determines whether or not the power key 30 was double-clicked. In a case where the power key 30 was double-clicked, the decision is made that the condition is satisfied and the flow proceeds to the above described step S50 where the CPU 12 executes power-off processing. On the other hand, in a case where the power key 30 has not been double-clicked, the decision is made that the condition is not satisfied and the flow proceeds to step S40 where the CPU 12 executes the above described feed processing. Then, the flow returns to the above described step S10.

As described above, according to this modification, the power key 30 is regarded as pressed and power-off processing is performed only when the power key 30 is double-clicked. With this arrangement, even if the operator mistakenly applies a larger pressing force to the power key 30 when operating the feed key 40, thereby simultaneously pressing the power key 30 and feed key 40, feed processing corresponding to the feed key 40 is executed without turning the power off if the keys were pressed once, making it possible to further increase the function of suppressing mistaken operation of the power key 30. Further, since operation of the power key 30 thus requires the key to be pressed twice, the advantage of the capability of preventing mistaken operation of the power key 30 by a contacting object, etc., at a time other than when operating the feed key 40, such as when carrying the handheld printer 1, for example, is also achieved.

(3) When the Rubber Member 53 is Provided on the Undercover 102 Side as Well While the rubber member 53 is provided between the first boss parts 161L and 161R of the top cover 101 and the installation parts 51 and 52 according to the above described embodiment, the rubber member 53 may be provided between the second boss parts 162L and 162R of the undercover 102 and the installation parts 51 and 52 as well. With this arrangement, even in a case where either of the top cover 101 or the undercover 102 is subjected to impact when the handheld printer 1 is dropped, etc., the impact transmitted to the chassis assembly 50 can be reliably absorbed, making it possible to achieve a handheld printer that offers even higher resistance to impact when dropped, etc.

(4) When a Locked Structure is Provided to Other Areas in Addition to Both Ends of the Battery Chamber Cover That is, in the above, the battery chamber cover 170 is installed based on a locked and engaged structure at both ends of the battery storage chamber 105. That is, the locking tabs 171 of the battery chamber cover 170 are locked into the locking holes 109 on the above-described left end side of the battery storage chamber 105, and the elastic engaging part 172 of the battery chamber cover 170 is engaged with the engaged part 110 on the above described right end side. Nevertheless, the present disclosure is not limited thereto, allowing provision of a locked structure in areas in addition to the above described both ends. The following describes the details of such a modification with reference to each figure, including FIG. 28 to FIG. 30.

As previously described, the battery chamber cover 170 is detachably provided to the battery storage chamber 105 provided on the rear side of the housing 100. With the battery chamber cover 170 removed, the above described battery storage chamber 105 opens to the rear surface section of the housing 100 (refer to FIG. 22). An upper locked part 101*a* and a lower locked part 102*a* for locking the locking and protruding parts 181A, 181B, and 182 of the battery chamber cover 170 are provided on the upper side and the lower side of the battery storage chamber 105 (refer to FIG. 19 and FIG. 22).

Figure 28:
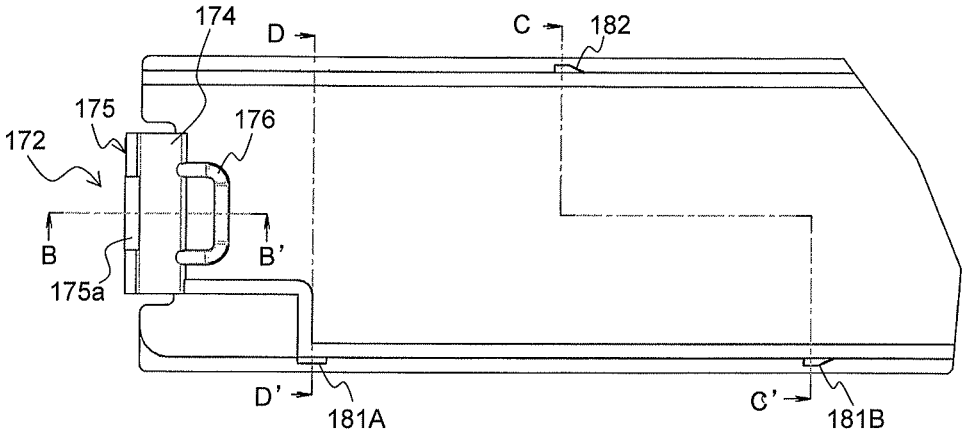
FIG. 28 is an enlarged top view of the main elements, as viewed from direction A in FIG. 25.
Figure 29:
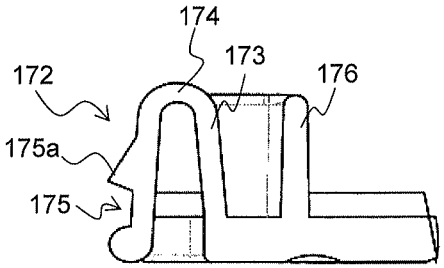
FIG. 29 is a cross-sectional view taken along line B-B' in FIG. 28.
Figure 30B:
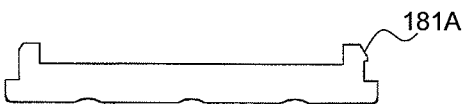
FIGS. 30A and 30B show cross-sectional views taken along lines C-C' and D-D' in FIG. 28.
Figure 30A:
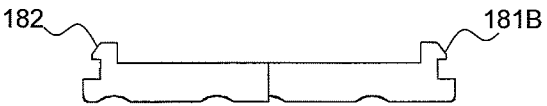

As described above, the battery chamber cover 170 comprises an upper/lower pair of the above described locking tabs 171 and the above described elastic engaging part 172. According to this modification, the battery chamber cover 170 further comprises a plurality of the locking and protruding parts 181A, 181B, and 182, as shown in FIG. 28, FIG. 30A, and FIG. 30B. The locking and protruding parts 181A, 181B, and 182 include at least one first protruding part (two first protruding parts 181A and 181B in this example), and at least one second protruding part (one second protruding part 182 in this example). The first protruding parts 181A and 181B and the second protruding part 182 are disposed in a substantially staggered manner so that the positions thereof along the longitudinal direction of the above described battery chamber cover 170 differ from each other. According to this example, the first protruding part 181A, the second protruding part 182, and the first protruding part 181B are disposed in a staggered manner in that order along the above described longitudinal direction. At this time, as already shown in FIG. 2, FIG. 19, FIG. 22, etc., the upper locked part 101*a* and the lower locked part 102*a* continually extend from one edge part to the other edge part of the opening of the battery storage chamber 105 in a longitudinal direction, and are configured as ribs for preventing the rechargeable battery 10 within the battery storage chamber 105 from slipping off under its own weight. Then, the two first protruding parts 181A and 181B are locked into the upper locked part 101*a* configured as a rib as described above, and the one second protruding part 182 is locked into the lower locked part 102*a* configured as a rib as described above.

Further, the plurality of locking and protruding parts 181A, 181B, and 182 is unevenly disposed in an area of the battery chamber cover 170 other than the above described left end and the above described right end along the above described longitudinal direction, specifically in either the area on the left side or the area on the right side, excluding the center part in a longitudinal direction. Note that, according to this example, the plurality of locking and protruding parts 181A, 181B, and 182 is unevenly disposed in the area on the right side (left lower side in FIG. 25) corresponding to the disposed position of the elastic engaging part 172 (in other words, the disposed position of the electric cables 25*a* of the harness 25). Note that, to avoid complexities in illustration, the locking and protruding parts 181A, 181B, and 182 are not shown other than in FIGS. 28, 30A, and 30B.

In the handheld printer 1 of this modification of the above described configuration, similar to that previously described, when the battery chamber cover 170 is installed to the battery storage chamber 105, the locking tabs 171 of the battery chamber cover 170 are locked into the locking holes 109 of the battery storage chamber 105 on the above described left end side, and the elastic engaging part 172 of the battery chamber cover 170 is engaged with the engaged part 110 of the battery storage chamber 105 on the above described right end side.

Then, according to this modification, the plurality of locking and protruding parts 181A, 181B, and 182 is further provided to positions other than the above described both ends (left end and right end) of the battery chamber cover 170 as previously described in order to strengthen the fixed structure in the middle between the above described left end and the above described right end. The first protruding parts 181A and 181B are locked into the upper locked part 101A, and the second protruding part 182 is locked into the lower locked part 102*a*. Thus, a locked structure of the battery chamber cover 170 and the battery storage chamber 105 is achieved with an upper side and a lower side in the width direction of the battery chamber cover 170 using sections other than the left end and right end previously described, making it possible to prevent a flexure and rise toward the outer surface side of the battery chamber cover 170, which can occur in the above described middle.

Further, the above described first protruding parts 181A and 181B and the second protruding part 182 are arranged in a substantially staggered manner so that the positions thereof along the longitudinal direction of the battery chamber cover 170 are not the same, but different from each other. With this arrangement, when the user removes the battery chamber cover 170 from a mounted state on the battery storage chamber 105, the resistance that occurs from the above described locked structure that uses each of the protruding parts 181A, 181B, and 182 is dispersed, making it possible for the user to relatively easily remove the battery chamber cover 170.

Further, as previously described, when the user mounts the battery chamber cover 170 onto the battery storage chamber 105, the user first fits the locking tabs 171 into the locking holes 109 on the left end. Subsequently, the user presses and elastically deforms the elastic engaging part 172 on the right end with a finger while maintaining the fit state, thereby engaging the elastic engaging part 172 with the engaged part 110. Thus, when mounting is performed based on a fixed structure of the left and right ends, when the user hurriedly performs mounting, or in a case where the pressing force is inadequate, etc., the possibility exists that the above described rise will not be completely resolved, causing a portion of the plurality of locking and protruding parts 181A, 181B, and 182 positioned in the middle of the left and right ends to not be locked or to be half locked (in an incompletely locked state).

Here, in particular, according to this modification, the plurality of locking and protruding parts 181A, 181B, and 182 is disposed in a left side area or right side area where the rise height is relatively low, staying clear of the center part in the above described longitudinal direction where the rise height becomes highest as a result of a bend such as previously described. With this arrangement, even in a case where the above described incompletely locked state temporarily occurs, it is possible to suppress the rise height of the locking and protruding parts 181A, 181B, and 182 in the unlocked state (or half-locked state) to a low degree. This makes it possible for the user to easily correct the state to the proper completely locked state by pressing the locking and protruding parts 181A, 181B, and 182 that are in the unlocked state (or half-locked state) once again.

Further, as previously described, when the battery chamber cover 170 is mounted, the locking tabs 171 are first fit into the locking holes 109, and then the elastic engaging part 172 is engaged with the engaged part 110 by the pressing force of the finger of the user. In particular, according to this modification, the plurality of locking and protruding parts 181A, 181B, and 182 is thus disposed on the same side as the elastic engaging part 172 which is lastly pressed by the finger during mounting. With this arrangement, when the elastic engaging part 172 is pressed, the pressing force is caused to simultaneously act on the locking and protruding parts 181A, 181B, and 182, making it possible to smoothly mount the battery chamber cover 170.

Conversely, when the battery chamber cover 170 is removed from the battery storage chamber 105, the user first elastically deforms the elastic engaging part 172 to disengage the above described engagement as previously described, and then separates the locking tabs 171 from the locking holes 109. With the plurality of locking and protruding parts 181A, 181B, and 182 disposed on the same side as the elastic engaging part 172 first operated by the finger at the time of removal, tensile force acts on the locking and protruding parts 181A, 181B, and 182 at the same time as the elastic engaging part 172 is elastically deformed, making it possible to smoothly remove the battery chamber cover 170.

Further, in particular, according to this modification, the plurality of locking and protruding parts 181A, 181B, and 182 is disposed on the same side as the electric cables 25*a* of the harness 25 that act on a reaction force, such as the battery chamber cover 170 being pressed toward the outer surface side, thereby reliably suppressing the above described reaction force, making it possible to prevent the rise and flexure of the battery chamber cover 170 toward the outer surface side.

Further, in particular, according to this modification, the first protruding part 181A, the second protruding part 182, and the first protruding part 181B are disposed in a staggered manner in that order along the above described longitudinal direction, making it possible to achieve a well-balanced distribution of each of the locking and protruding parts 181A, 181B, and 182 and prevent the rise of the battery chamber cover 170. Further, suppression of the total number of locking and protruding parts 181A, 181B, and 182 to three reliably suppresses the resistance that occurs by the locked structure when the user removes the battery chamber cover 170, making it possible for the user to reliably remove the battery chamber cover 170 with ease.

Further, in particular, according to this modification, the upper locked part 101*a* and the lower locked part 102*a* are each configured by a rib that is continually extended from the left side edge part to the right side edge part of the opening of the battery storage chamber 105. With this arrangement, the ribs provided to prevent the rechargeable battery 10 within the battery storage chamber 105 from slipping off under its own weight are utilized to lock the first protruding parts 181A and 181B and the second protruding part 182 and prevent a rise in the battery chamber cover 170.

(5) Other

Figure 3:
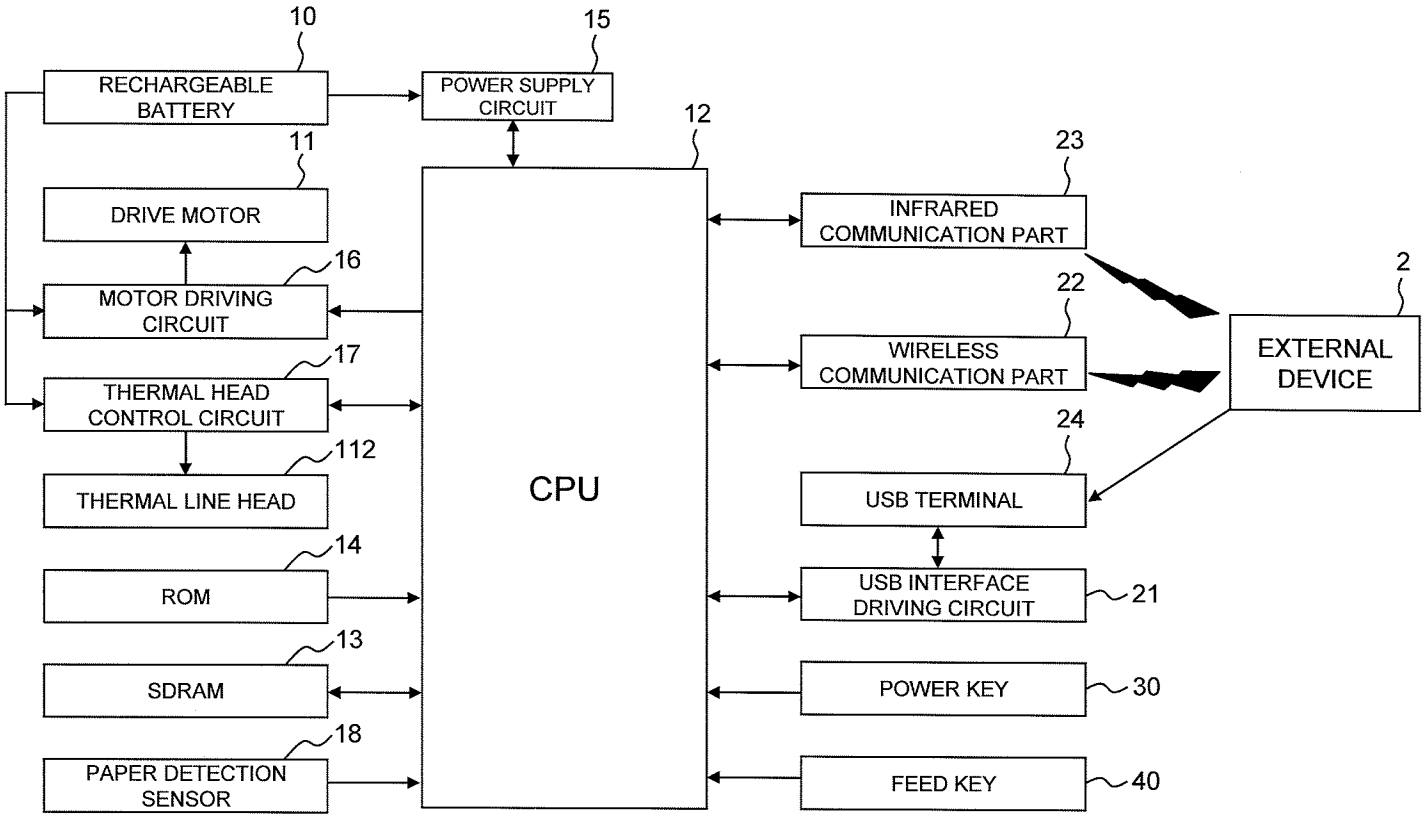
FIG. 3 is a block diagram showing the functional configuration of the handheld printer.

In the above, the arrow shown in the FIG. 3 denotes an example of signal flow, but the signal flow direction is not limited thereto. Also the present disclosure is not limited to the procedures shown in the above described flowcharts of FIG. 8, FIG. 26, and FIG. 27, and procedure additions and deletions as well as sequence changes may be made without departing from the spirit and scope of the disclosure.

Further, other than that already stated above, techniques based on the above-described embodiments and each of the modifications may be suitably utilized in combination well.

What is claimed is:

1. A handheld printer comprising:

a battery power supply;

a platen roller configured to feed a print-receiving paper;

a thermal line head configured to perform desired printing on said print-receiving paper fed by said platen roller;

a device main body comprising a battery storage chamber configured to store said battery power supply; and a battery chamber cover detachably configured to be mounted on said battery storage chamber, wherein:

said device main body encloses said platen roller and said thermal line head;

said battery power supply comprises a dimension along a longitudinal direction and a dimension along a width direction that is shorter than the dimension along the longitudinal direction, and is provided to drive said platen roller and said thermal line head;

said battery storage chamber comprises:

a locking hole provided to one side end of said battery storage chamber in the longitudinal direction;

an engaged part provided to the other side end of said battery storage chamber in the longitudinal direction; and a one side locked part and an other side locked part respectively provided to one side and the other side of said battery storage chamber in the width direction, and said battery chamber cover comprises:

a locking tab configured to fit into said locking hole, provided to one side end of said battery chamber cover in the longitudinal direction;

an elastic engaging part configured to elastically deform and engage with said engaged part, provided to the other side end of said battery chamber cover in the longitudinal direction; and a plurality of locking and protruding parts that includes at least one first protruding part and at least one second protruding part that respectively lock into said one side locked part and said other side locked part, disposed in a substantially staggered manner so that the positions along the longitudinal direction are different from each other in positions other than said one side end and said other side end.

2. The handheld printer according to claim 1, wherein:

said plurality of locking and protruding parts is unevenly disposed on said battery chamber cover, in either an area of said one side in the longitudinal direction or an area of said other side in the longitudinal direction.

3. The handheld printer according to claim 2, wherein:

said plurality of locking and protruding parts is unevenly disposed on said battery chamber cover, in an area of said other side in the longitudinal direction corresponding to said elastic engaging part.

4. The handheld printer according to claim 2, wherein:

said battery power supply is connected to an electric cable of a harness in the other side section of said battery power supply in the longitudinal direction when stored in said battery storage chamber; and said plurality of locking and protruding parts is unevenly disposed on said battery chamber cover, in said other side area in the longitudinal direction where said electric cable of said harness is provided.

5. The handheld printer according to claim 2, wherein:

said plurality of locking and protruding parts includes two said first protruding parts and one said second protruding part, and one of said two first protruding parts, said second protruding part, and the other of said two first protruding parts are disposed in a staggered manner in that order along the longitudinal direction.

6. A handheld printer comprising:

a battery power supply;

a platen roller configured to feed said print-receiving paper;

a thermal line head configured to perform desired printing on said print-receiving paper fed by said platen roller;

a device main body comprising a battery storage chamber configured to store said battery power supply; and a battery chamber cover detachably configured to be mounted on said battery storage chamber, wherein:

said battery chamber cover comprises:

a locking tab configured to fit into a locking hole provided to one end of said battery storage chamber in a longitudinal direction, provided to one end in a longitudinal direction;

an elastic engaging part configured to elastically deform and engage with an engaged part provided to the other end of said battery storage chamber in the longitudinal direction, provided to the other end in the longitudinal direction; and a harness pressing part configured to press an electric cable of a harness connected to said battery power supply stored during mounting to said battery storage chamber, provided near said elastic engaging part.

7. The handheld printer according to claim 6, wherein:

said harness pressing part is a rib part arranged on an inner surface of said battery chamber cover so that said rib part is adjacent to said elastic engaging part.

8. The handheld printer according to claim 7, wherein:

said elastic engaging part comprises:

a support part arranged from an inner surface of said battery chamber cover toward the inside of said battery storage chamber;

a curving part provided at a tip of said support part; and a tip part configured to engage with said engaged part while moving toward and away from said support part by a flexure of said curving part, and said rib part is provided adjacent to said support part.

9. The handheld printer according to claim 8, wherein:

said rib part comprises a hollow structure of a cross-sectional sideways u-shape opening to the left, with the open side connected to said support part.

* * * * *